US009823596B2

(12) United States Patent
Kadonome et al.

(10) Patent No.: US 9,823,596 B2
(45) Date of Patent: Nov. 21, 2017

(54) ELECTROSTATIC IMAGE DEVELOPING TONER AND TWO-COMPONENT ELECTROSTATIC IMAGE DEVELOPER

(71) Applicant: Konica Minolta, Inc., Tokyo (JP)

(72) Inventors: Futoshi Kadonome, Sagamihara (JP); Satoshi Uchino, Hino (JP); Shinya Obara, Fuchu (JP); Noriyuki Kimpara, Toyohashi (JP); Ikuko Sakurada, Hachioji (JP); Takuya Takahashi, Higashimurayama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/267,808

(22) Filed: Sep. 16, 2016

(65) Prior Publication Data

US 2017/0090324 A1 Mar. 30, 2017

(30) Foreign Application Priority Data

Sep. 30, 2015 (JP) ..... 2015-193031

(51) Int. Cl.

| | |
|---|---|
| ***G03G 9/097*** | (2006.01) |
| ***G03G 9/08*** | (2006.01) |
| ***G03G 9/087*** | (2006.01) |
| ***G03G 9/09*** | (2006.01) |
| ***G03G 9/113*** | (2006.01) |

(52) U.S. Cl.

CPC ..... *G03G 9/09783* (2013.01); *G03G 9/0819* (2013.01); *G03G 9/08711* (2013.01); *G03G 9/08755* (2013.01); *G03G 9/0918* (2013.01); *G03G 9/113* (2013.01)

(58) Field of Classification Search

CPC ..... G03G 9/09708; G03G 9/09716; G03G 9/09725

See application file for complete search history.

(56) References Cited

U.S. PATENT DOCUMENTS

| | | | | |
|---|---|---|---|---|
| 6,383,704 | B1 * | 5/2002 | Kataoka | G03G 9/08782 430/108.6 |
| 2006/0057486 | A1 * | 3/2006 | Moriyama | C08L 67/02 430/109.4 |

FOREIGN PATENT DOCUMENTS

| | | | |
|---|---|---|---|
| JP | H07-244397 | A | 9/1995 |
| JP | 2009-025809 | A | 2/2009 |
| JP | 2011-047987 | A | 3/2011 |
| JP | 2011197659 | A | 10/2011 |
| JP | 2012-168222 | A | 9/2012 |

(Continued)

OTHER PUBLICATIONS

Notification of Teason for Refusal dated Oct. 10, 2017 from the corresponding Japanese Patentn Application No. JP 2015-193031 and English translation.

*Primary Examiner* — Hoa V Le

(74) *Attorney, Agent, or Firm* — Lucas & Mercanti, LLP

(57) ABSTRACT

Provided is an electrostatic image developing toner including a toner mother particle containing a colorant and a binder resin comprising a crystalline resin and an amorphous resin; and an external additive. The external additive includes an inorganic fine particle having a number average major axis in a range of 50 to 100 nm, an average aspect ratio in a range of 3 to 10, and a volume resistivity in a range of $1\times10^{10}$ to $1\times10^{12}$ Ω·cm in primary particles.

9 Claims, 1 Drawing Sheet

(56) References Cited

FOREIGN PATENT DOCUMENTS

| | | | |
|---|---|---|---|
| JP | 2013235046 | A1 | 11/2013 |
| JP | 2015-125302 | A | 7/2015 |

* cited by examiner

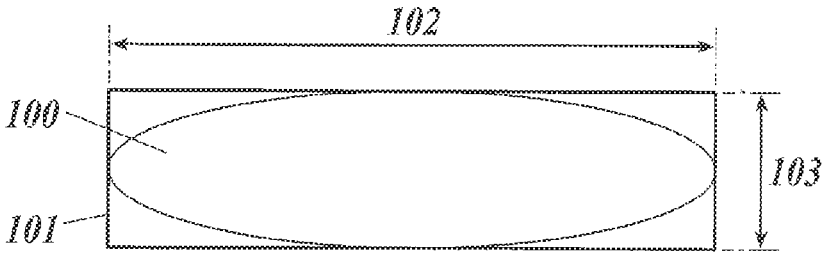
102
100
101
103

ELECTROSTATIC IMAGE DEVELOPING TONER AND TWO-COMPONENT ELECTROSTATIC IMAGE DEVELOPER

This application is based on Japanese Patent Application No. 2015-193031 filed on Sep. 30, 2015 with Japan Patent Office, the entire content of which is hereby incorporated by reference.

BACKGROUND OF THE INVENTION

1. Field of the Invention

The present invention relates to an electrostatic image developing toner and a two-component electrostatic image developer.

2. Description of the Related Art

Increasing printing speed in digital printing which outputs images through electrophotographic processes requires toners to have higher low-temperature fixability during fixation of toner images. As toners having higher low-temperature fixability, crystalline resin-including toners have recently been in development. In addition, as toners having both low-temperature fixability and thermal storage stability (i.e., blocking resistance), toners containing a crystalline resin and amorphous resin have been proposed (see Japanese Unexamined Patent Application Publication No. 2011-197659, for example).

Digital printing, which can output various prints each of which is outputted in a small number, is much more advantageous than offset printing, which should make proofs for printing. In this context, requirement for digital printing is to output various prints successively from ones having high printing rates (high coverage rates), such as photobooks which desirably have high image quality, to ones having low printing rates (low coverage rates), such as address labels of direct mails.

Printing images having high coverage rate consumes large amount of a toner. Thus, much of the toner comes into contact with a carrier and an external additive relocates onto the surface of the carrier, resulting in a ready change in charge level of the toner. In contrast, since printing images having low coverage rate refreshes a toner at relatively low frequencies, the toner undergoes larger stress. Consequently, an external additive is embedded and charge level of the toner decreases, resulting in a decrease in image quality of output images.

Digital printing also requires to retain the charge of the toner at a proper level and to stably output high quality images under conditions such as high temperature and humidity (HH) and low temperature and humidity (LL) environments.

As described, the charge level of a toner should be stable under various conditions including printing environments and/or coverage rates set by users. Thus, ways for achieving such stability have been studied (see Japanese Unexamined Patent Application Publication No. 2013-235046, for example).

SUMMARY OF THE INVENTION

Unfortunately, use of a crystalline resin and amorphous resin as a binder resin in a toner mother particle for ensuring low-temperature fixability and thermal storage stability causes problems in retaining the charge level of the toner, due to low resistivity of the crystalline resin. In particular, the charge level decreases in the case of high coverage rate where an external additive is embedded and in the case of high temperature and humidity (HH) environments. Thus, the charge level of the toner should be more stable to stably output high quality images under any condition through electrophotographic processes with a crystalline resin-containing toner.

An object of the present invention, which has been made to resolve the above problems, is to provide an electrostatic image developing toner including a toner mother particle and an external additive, the electrostatic image developing toner containing a crystalline resin and an amorphous resin, which electrostatic image developing toner has both low-temperature fixability and thermal storage stability and also has highly stable charge level under various conditions, such as printing environments and/or coverage rates.

The present inventors, who have conducted intensive studies to solve the above problems and accomplish the above object, have completed an electrostatic image developing toner containing a toner mother particle and an external additive, the electrostatic image developing toner containing a colorant and a binder resin containing a crystalline resin and an amorphous resin, wherein an inorganic fine particle having a specific number average major axis, a specific average aspect ratio, and a specific volume resistivity is used as the external additive.

The above-described object of the present invention can be solved by the following embodiments.

1. An electrostatic image developing toner including:

a toner mother particle containing a colorant and a binder resin including a crystalline resin and an amorphous resin; and an external additive, wherein the external additive includes an inorganic fine particle having a number average major axis in a range of 50 to 100 nm, an average aspect ratio in a range of 3 to 10, and a volume resistivity in a range of $1\times10^{10}$ to $1\times10^{12}$ Ω·cm in primary particles.

2. The electrostatic image developing toner of the embodiment 1, wherein the inorganic fine particle includes rutile titanium dioxide surface-modified with an alkoxy silane coupling agent having an alkyl group.

3. The electrostatic image developing toner of the embodiment 1, wherein the external additive includes the inorganic fine particle and a silica particle having a number average primary particle size in a range of 60 to 150 nm.

4. The electrostatic image developing toner of the embodiment 1, wherein the crystalline resin includes a crystalline polyester.

5. The electrostatic image developing toner of the embodiment 2, wherein the alkoxysilane coupling agent includes an alkoxy silane coupling agent having an alkyl group represented by Formula (1):

$$R_1\text{—}Si(OR_2)_3 \qquad \text{Formula (1)}$$

wherein $R_1$ represents a linear alkyl group having a carbon number of 4 to 16 and optionally having a substituent; and $R_2$ represents a methyl or ethyl group.

6. The electrostatic image developing toner of the embodiment 1, wherein the inorganic fine particle is added in an amount in a range of 0.1 to 1.0 part by mass relative to 100 parts by mass of the toner mother particle.

7. The electrostatic image developing toner of the embodiment 1, wherein the amorphous resin content in the toner mother particle is in a range of 70 to 99 mass % to the total mass of the binder resin.

8. A two-component electrostatic image developer including the electrostatic image developing toner of the embodiment 1 and a carrier particle.

9. The two-component developer of the embodiment 8, wherein the carrier particle is a coated type carrier particle including a core and a shell covering the surface of the core, and the shell includes a resin having a cycloalkyl group.

BRIEF DESCRIPTION OF THE DRAWING

The present invention is fully understood from the detailed description given hereinafter and the accompanying drawings, which are given byway of illustration only, and thus are not intended to limit the present invention, wherein:

FIG. 1 is a diagram illustrating definitions of the number average major axis and number average minor axis of primary particles of an inorganic fine particle of the present invention.

DETAILED DESCRIPTION OF THE INVENTION

The present invention, its components, and embodiments for carrying out the present invention will now be described in detail. In the present specification, every range described with to includes its upper and lower limits.

One embodiment of the present invention provides an electrostatic image developing toner including a toner mother particle and an external additive, the toner mother particle containing a colorant and a binder resin containing a crystalline resin and an amorphous resin, wherein the external additive contains an inorganic fine particle having a number average major axis in a range of 50 to 100 nm, an average aspect ratio in a range of 3 to 10, and a volume resistivity in a range of $1\times10^{10}$ to $1\times10^{12}$ Ω·cm in primary particles (hereinafter this inorganic fine particle is also referred to as the "inorganic fine particle of the present invention").

This technical feature is common to or corresponds to the inventions relating to the above-described embodiments.

As mentioned above, the use of a crystalline resin which has superior sharp melting characteristics and an amorphous resin as a binder resin have been proposed to obtain toners having both low-temperature fixability and thermal storage stability.

Unfortunately, the use of crystalline resin, which has low resistivity, in a toner mother particle causes problems in retaining the charge level of the toner. In particular, the charge level decreases in the case of high coverage rate where an external additive is embedded and in the case of high temperature and humidity (HH) environments. The decrease in the charge level of the toner results in image defects, such as a decrease in image density and fogs.

The present invention improves the stability of the charge level of the toner in any environments and coverage rates by virtue of the inorganic fine particle having a specific number average major axis, a specific average aspect ratio, and a specific volume resistivity as an external additive. Use of the inorganic fine particle having a number average major axis in the rage of 50 to 100 nm in primary particles prevents the inorganic fine particle on the surface of the toner mother particle from embedment and separation.

In addition, the inorganic fine particle of the present invention has an average aspect ratio in the range of 3 to 10. An aspect ratio within this range leads to a large contact area between the inorganic fine particle and the toner mother particle, which prevents relocation of the inorganic fine particle across the toner mother particle. Consequently, the toner mother particle can be maintained to be evenly covered with the inorganic fine particle even when the toner mother particle undergoes strong stress, such as continuous agitation in a developing device. Thus, the charge level of the toner can be stable under any coverage rates.

As described above, the inorganic fine particle of the present invention having a specific number average major axis and a specific average aspect ratio in primary particles can retain the charge level of the toner without embedment or separation of the inorganic fine particle.

Furthermore, the inorganic fine particle of the present invention has a volume resistivity in a range of $1\times10^{10}$ to $1\times10^{12}$ Ω·cm in primary particles. Titanium oxide, which has been used as an inorganic fine particle, can prevent excess charge of the toner in low temperature and humidity (LL) environments by virtue of its low resistivity. Unfortunately, in the case where a crystalline resin is used in the toner mother particle, titanium oxide decreases the resistivity of the overall toner. Given this problem, the specific range of the volume resistivity, which is lower than that, $1\times10^{13}$ Ω·cm or more, of silica and is higher than that of existing titanium oxide, is selected to prevent the excess charge of the toner in LL environments and retain the charge at a proper level in HH environments, which decreases the fluctuation in charge level in different environments.

Use of existing titanium oxide also loses the charge and decreases the charge level of the toner in the cases of high coverage rates where the titanium oxide is separated from the toner and relocates onto the surface of silica. In contrast, the inorganic fine particle of the present invention can prevent a decrease in the charge level of the toner even when the inorganic fine particle is separated from the toner and relocates onto the surface of the carrier.

The toner of the present invention can accordingly have both low-temperature fixability and thermal storage stability, and the charge level of the toner of the present invention is more stable than ever under any printing conditions and coverage rates, especially under HH environments and high coverage rates. Hence, the present invention accomplishes stable output of high quality images.

Embodiments of the present invention will now be described, but the present invention is not limited to them. In the present specification, the description of a range "X to Y" denotes "X or higher and Y or lower", and operations and measurements of properties are to be performed at room temperature (25° C.) and a relative humidity in the range of 40 to 50%, unless described otherwise.

[Toner Mother Particle]

The toner mother particle of the present invention contains a colorant, and a crystalline resin and amorphous resin which are used as a binder resin in combination. The toner mother particle of the present invention is composed of toner particles having an external additive thereon.

In the present invention, the "electrostatic image developing toner" (hereinafter also simply referred to as the "toner") denotes a collection of the "toner particles".

[Binder Resin]

The binder resin of the present invention contains a crystalline resin and an amorphous resin.

<Crystalline Resin>

A crystalline resin used in the present invention exhibits not a step-like endothermic shift but a distinct endothermic peak in differential scanning calorimetry (DSC). A distinct endothermic peak has a half width of 15° C. or less in differential scanning calorimetry (DSC) performed at a heating rate of, for example, 10° C./min or less. Examples of crystalline resins include crystalline polyester resins and crystalline vinyl resins. Any crystalline resin can be used in the present invention. Crystalline polyester resins are preferred, and crystalline aliphatic polyester resins are more preferred, in view of accomplishment of the low-temperature fixability, the charge level, and adjustment of the melting point within a preferred range described later.

A variety of known polyester resins prepared by polycondensation of di- or poly-carboxylic acid and di- or polyhydric alcohol (polyol) can be used in the present invention. A crystalline resin used in the present invention exhibits not a step-like endothermic shift but a distinct endothermic peak in differential scanning calorimetry (DSC). In the present specification, a distinct endothermic peak has a half width of 15° C. or less in differential scanning calorimetry (DSC) that is described in Examples and is performed at a heating rate of 10° C./min or less.

Any crystalline resin having the above-mentioned characteristics can be used. For example, a crystalline polyester resin used in the present invention may be a copolymer resin that is composed of a crystalline polyester component as a main chain copolymerized with a different monomer and has a distinct endothermic peak.

Preferably, a crystalline polyester resin has a weight-average molecular weight (Mw) in the range of 2,000 to 20,000 measured with a gel permeation chromatograph (GPC). This range leads to a toner particle having not low melting point, preferred blocking resistance, and preferred low-temperature fixability, as a whole.

A crystalline polyester resin has a melting point (Tm) of preferably 50° C. or higher and lower than 120° C., more preferably 60° C. or higher and lower than 90° C. determined with a differential scanning calorimeter (DSC). These ranges of the melting point lead to preferred low-temperature fixability, and preferred fixing and separation characteristics. The melting point of a crystalline polyester resin is an endothermic peak defined with DSC. For example, Tm of a crystalline resin can be measured with a differential scanning calorimeter in accordance with ASTM D3418. In this measurement, melting points of indium and zinc are used in temperature calibration of a detector of the calorimeter, and heat of fusion of indium is used in calorimetric calibration. A sample is placed in an aluminum pan, and a vacant pan is used as a control. The temperature program includes heating at a heating rate of 10° C./min, holding at 200° C. for 5 minutes, cooling from 200° C. to 0° C. in a liquid nitrogen stream at a cooling rate of −10° C./min, holding at 0° C. for 5 minutes, and then heating from 0° C. to 200° C. at a heating rate of 10° C./min. The endothermic curve of the second heating step is analyzed, and the maximum point in the endothermic curve is defined as Tm of the crystalline polyester resin sample.

The crystalline polyester resin preferably has an acid value (AV) in the range of 5 to 45 mg KOH/g, more preferably 5 to 30 mg KOH/g. An acid value of 45 mg KOH/g or less is preferred because such an acid value leads to low moisture absorption and a small decrease in charge level by moisture absorption in high humidity environments. An acid value of 5 mg KOH/g or more is preferred because such an acid value stabilizes dispersion state of resin fine particles and facilitates production of the toner.

A crystalline polyester resin is prepared with a polycarboxylic acid and polyhydric alcohol. The number of carboxylic groups and hydroxyl groups are each preferably 2 or 3, and more preferably 2 (namely, dicarboxylic acid and diol are more preferred).

One or more polycarboxylic acids may be used. Examples include aliphatic dicarboxylic acids, aromatic dicarboxylic acids, dicarboxylic acids having double bonds, carboxylic acids having three or more carboxylic groups, their acid anhydrides, and their lower alkyl esters. Dicarboxylic acids having double bonds are preferred because they are cross-linkable by a radical reaction and prevents hot offset of toner particles during fixation.

Aliphatic dicarboxylic acids are preferred and may be used with an aromatic dicarboxylic acid(s) in combination. Preferred aliphatic dicarboxylic acids have linear chains, because such aliphatic dicarboxylic acids facilitate crystallization. In the present invention, a mixture of two or more dicarboxylic acids may also be used. Linear aliphatic dicarboxylic acids having a carbon number of 7 to 20 of the main chains are more preferred.

Examples of aliphatic dicarboxylic acids include oxalic acid, malonic acid, succinic acid, glutaric acid, adipic acid, pimelic acid, suberic acid, azelaic acid, sebacic acid, 1,9-nonane dicarboxylic acid, 1,10-decanedicarboxylic acid, 1,10-dodecane dicarboxylic acid (1,10-dodecanedioic acid), 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, 1,18-octadecane dicarboxylic acid, their lower alkyl esters, and their acid anhydride.

In view of availability, linear aliphatic dicarboxylic acids having a carbon number of 6 to 14 of the main chains are preferred, and adipic acid, 1,8-octane dicarboxylic acid, 1,9-nonanedicarboxylic acid, 1,10-decanedicarboxylic acid, and 1,10-dodecane dicarboxylic acid (1,10-dodecanedioic acid) are more preferred.

Examples of aromatic dicarboxylic acids include terephthalic acid, isophthalic acid, o-phthalic acid, t-butyl isophthalic acid, 2,6-naphthalene dicarboxylic acid, and 4,4'-biphenyldicarboxylic acid. Among them, terephthalic acid, isophthalic acid, and t-butyl isophthalic acid are preferred in view of availability and ready emulsification.

Examples of dicarboxylic acids having double bonds include maleic acid, fumaric acid, 3-hexenedioic acid, and 3-octenedioic acid. Among them, fumaric acid and maleic acid are preferred in view of cost.

Examples of carboxylic acids having three or more carboxylic groups include 1,2,4-benzene tricarboxylic acid, 1,2,5-benzene tricarboxylic acid, and 1,2,4-naphthalene tricarboxylic acid.

Defining that the molar percentage of all the dicarboxylic acid(s) used to prepare a crystalline polyester resin is 100 mol %, the molar percentage of an aliphatic dicarboxylic acid(s) to all the used dicarboxylic acid(s) is preferably 80 mol % or more, more preferably 90 mol % or more, further more preferably 100 mol %. A molar percentage of an aliphatic dicarboxylic acid(s) of 80 mol % or more ensures crystallinity of a crystalline polyester resin, superior low-temperature fixability of toner products, formation of glossy output images, and deterioration in image quality due to low melting point is suppressed. In addition, an emulsion is certainly obtained when an oil liquid containing the above-mentioned crystalline polyester resin is used to form oil droplets.

One or more polyols may be used. Examples include aliphatic diols and alcohols having three or more hydroxyl groups. Among them, aliphatic diols are preferred for preparing a crystalline polyester resin. One or more diols other than aliphatic diol may also be used together with aliphatic diol to prepare a crystalline polyester resin as needed. Linear aliphatic diols having a carbon number of 7 to 20 of the main chains are more preferred.

Such linear aliphatic diols retains crystallinity of a polyester without a decrease in the melting point of the polyester containing the linear aliphatic diols. Thus, such linear aliphatic diols ensures superior blocking resistance of a toner, long-term stability of image quality, and low-temperature fixability and are therefore preferred. A carbon number of 7 to 20 of the main chain is preferred because such carbon numbers can prevent an increase in the melting point of a polycondensation product of the preferred diol and an aromatic dicarboxylic acid, ensure the low-temperature fixability, and are available in practice. A carbon number of 7 to 20 of the main chain is preferred in view of these facts.

Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetra decanediol, 1,18-octadecandiol, and 1,14-eicosane decanediol. Among them, 1,8-octanediol, 1,9-nonanediol, and 1,10-decanediol are preferred in view of availability.

Branched aliphatic diols may also be used. In view of ensuring crystallinity, a branched aliphatic diol is preferably used in combination with a linear aliphatic diol, and the proportion of the amount of the linear aliphatic diol to that of the branched aliphatic diol is preferably high. Such a high proportion ensures crystallinity, low-temperature fixability of a prepared toner, suppression of deterioration in image quality due to low melting point, and blocking resistance.

The diols may be used alone or in combination.

Defining that the molar percentage of all the diol(s) used to prepare a crystalline polyester resin is 100 mol %, the molar percentage of an aliphatic diol(s) to all the used dicarboxylic acid(s) is preferably 80 mol % or more, more preferably 90 mol % or more, further more preferably 100 mol %. A molar percentage of an aliphatic diol(s) to all the used diol(s) of 80 mol % or more ensures crystallinity of a crystalline polyester resin, preferred low-temperature fixability of a toner product, and formation of glossy output images.

Examples of alcohols having three or more hydroxyl groups include glycerol, trimethylolethane, trimethylolpropane, and pentaerythritol.

A crystalline polyester resin may be prepared with any one or more of the above-mentioned resin components by any known method, for example, transesterification, direct polycondensation, or a combination thereof.

For example, polymerization may be performed at a temperature in the range of 180 to 230° C., under reduced pressure as needed, and/or in parallel with removal of water and alcohol generated by the condensation. In the case of using a monomer that does not dissolve and/or is not miscible with other monomers at a reaction temperature, a solubilizing agent having a high boiling point may be used to dissolve such a monomer. Such a solubilizing agent is distilled away in parallel with polycondensation. In the case of using a monomer having low miscibility in copolymerization, it is preferred to condensate such a monomer with an acid or alcohol and then polycondensate the resulting condensation product and a main polymer component.

To adjust the molecular weight of the binder resin, a chain transfer agent may be used in combination with monomers for preparing the binder resin. One or more chain transfer agents may be used in an amount that achieves the advantageous effects of embodiments of the present invention and accomplishes the above object. Examples of the chain transfer agents include 2-chloroethanol; mercaptans, such as octyl mercaptan, dodecyl mercaptan, and t-dodecyl mercaptan; mercaptopropionic acids, such as n-octyl 3-mercaptopropionate and stearyl 3-mercaptopropionate; and styrene dimers.

The equivalence ratio of the hydroxyl group [OH] of the diol(s) to the carboxyl group [COOH] of the dicarboxylic acid used in preparation of the binder resin are preferably in the range of 1.5/1 to 1/1.5, more preferably 1.2/1 to 1/1.2. Such ranges ensure production of the crystalline polyester resin having a preferred molecular weight.

A catalyst may be used in the preparation of the crystalline polyester resin. Examples include alkali metal compounds, such as sodium and lithium compounds; alkaline earth metal compounds, such as magnesium and calcium compounds; other metal compounds, such as aluminum, zinc, manganese, antimony, titanium, tin, zirconium, and germanium compounds; phosphites; phosphates; and amines. Examples of tin compounds include dibutyltin oxide, tin octylate, tin dioctylate, and salts thereof. Examples of titanium compounds include titanium alkoxides, such as tetra-n-butyl titanate, tetraisopropyl titanate, tetramethyl titanate, and tetrastearyl titanate; titanium acylates, such as polyhydroxy titanium stearate; titanium chelates, such as titanium tetraacetylacetonate, titanium lactate, and titanium triethanolaminate. Examples of germanium compounds include germanium dioxide. Examples of aluminum compounds include oxides, such as poly(aluminum hydroxide); aluminum alkoxides; and tributyl aluminate. The catalysts may be used alone or in combination.

(Crystalline Resin Content)

The crystalline resin content in the toner mother particle is preferably in the range of 1 to 30 mass %. A content of 1 mass % or more of the crystalline resin in the toner mother particle is preferred to achieve advantageous effects of the present invention. A content of 30 mass % or less of the crystalline resin in the toner mother particle prevents thermal agglomeration of toner particles (blocking). More preferably, the crystalline resin content in the toner mother particle is in the range of 8 to 18 mass %.

The mass of the crystalline resin relative to the mass of the binder resin and the colorant in the toner (in terms of solid content) is preferably in the range of 1 to 30 mass %, more preferably 8 to 18 mass %. The mass of the binder resin and the colorant can be calculated from the mass of their raw materials fed in the reaction system for preparing the toner mother particle.

<Amorphous Resin>

Examples of the amorphous binder resin include styrene-(meth)acrylic resins, amorphous polyester resins, and styrene-acrylic-modified polyester resins. Styrene-(meth) acrylic resins are superior in that the charge level can be readily controlled. Use of styrene-(meth)acrylic resin as the binder resin can enhance plasticity during thermal fixation.

A styrene-acrylic resin is prepared by addition polymerization of a styrene monomer and a (meth)acrylate ester monomer. Examples of the styrene monomers include styrene represented by the formula $CH_2{=}CH{-}C_6H_5$, and styrene derivatives containing known side chains and/or functional groups. Examples of the (meth)acrylate ester monomers include acrylate esters and methacrylic esters represented by the formula $CH_2{=}CHCOOR$ (R is an alkyl group), and derivatives of acrylate and methacrylate esters that contain known side chains and/or functional groups. Nonlimiting examples of styrene monomers and (meth) acrylate ester monomers that can be used in the present invention are listed below.

Examples of the styrene monomers and derivatives thereof include styrene, o-methylstyrene, m-methylstyrene, p-methylstyrene, p-methoxylstyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, and 3,4-dichlorostyrene. These styrene monomers may be used alone or in combination.

Examples of the (meth)acrylate ester monomers include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxyethyl acrylate, γ-aminopropyl acrylate, stearyl methacrylate, dimethylaminoethyl methacrylate, and diethylaminoethyl methacrylate. These styrene monomers and (meth)acrylate ester monomer may be used alone or in combination.

Other monomers may be polymerized into the styrene-acrylic resin. Examples include acrylic acid, methacrylic acid, maleic acid, itaconic acid, cinnamic acid, fumaric acid, maleic acid monoalkyl ester, itaconic acid monoalkyl ester, 2-hydroxyethyl (meth)acrylate, 2-hydroxypropyl (meth) acrylate, 3-hydroxypropyl (meth)acrylate, 2-hydroxybutyl (meth)acrylate, 3-hydroxybutyl (meth)acrylate, 4-hydroxybutyl (meth)acrylate, and poly(ethylene glycol) mono(meth) acrylate.

The structural unit content derived from the styrene monomer in the styrene acrylic resin is preferably in the range of 40 to 89.5 mass %. The structural unit content derived from the (meth)acrylate ester monomer in the styrene acrylic resin is preferably in the range of 10 to 59.5 mass %. These ranges lead to ready control of the plasticity of the amorphous resin.

The structural unit content derived from the other monomer(s) in the styrene acrylic resin is preferably in the range of 0.5 to 30 mass %.

A styrene-(meth)acrylic resin may be prepared by any known method, such as polymerization of monomers in the presence of a known oil- or water-soluble polymerization initiator. Examples of the oil-soluble polymerization initiator include azo or diazo polymerization initiators and peroxide polymerization initiators described below.

Examples of azo or diazo polymerization initiators include 2,2'-azobis-(2,4-dimethyl valeronitrile), 2,2'-azobisisobutyronitrile, 1,1'-azobis(cyclohexane-1-carbonitrile), 2,2'-azobis-4-methoxy-2, 4-dimethyl valeronitrile, and azobisisobutyronitrile.

Examples of the peroxide polymerization initiators include benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis(4, 4-di-t-butylperoxycyclohexyl)propane, and tris-(t-butylperoxy)triazine.

The amorphous resin is a polyester resin other than the above-mentioned crystalline polyester resin (a resin not having the above-mentioned distinct endothermic peak). That is, the amorphous resin normally has no melting point but has relatively high glass transition temperature (Tg) preferably in the range of 40 to 90° C., more preferably 45 to 80° C. The amorphous resin is prepared by condensation of a polyol and a polycarboxylic acid.

Any polyol may be used, and examples include aliphatic diols, such as ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecandiol, and 1,20-eicosanediol; bisphenols, such as bisphenol A, bisphenol F, and alkylene oxide adducts of bisphenols, such as ethylene oxide adducts and propylene oxide adducts; alcohols having three or more hydroxyl groups, such as glycerol, trimethylolpropane, pentaerythritol, and sorbitol. In terms of production cost and environmental effects, other polyols, such as cyclohexane dimethanol, cyclohexanediol, and neopentyl alcohol, may also be used. In addition, unsaturated polyhydric alcohols, such as 2-butyne-1,4-diol, 3-butyne-1,4-diol, and 9-octadecene-7,12-diol, may also be used as polyols for preparing the amorphous resin.

Examples of dicarboxylic acid to be condensed with the above polyols include aromatic carboxylic acids, such as terephthalic acid, isophthalic acid, phthalic anhydride, trimellitic anhydride, pyromellitic acid, and naphthalenedicarboxylic acid; aliphatic carboxylic acids, such as maleic anhydride, fumaric acid, succinic acid, alkenyl succinic acid, adipic acid, suberic acid, azelaic acid, sebacic acid, 1,9-nonanedicarboxylic acid, 1,10-decanedicarboxylic acid, 1,10-dodecanedicarboxylic acid, dodecane-1,12-dicarboxylic acid, tetradecane-1,14-dicarboxylic acid, and octadecane-1,18-dicarboxylic acid; cycloaliphatic carboxylic acids, such as cyclohexanedicarboxylic acid; lower alkyl esters thereof; and acid anhydrides thereof. These dicarboxylic acids may be used alone or in combination.

Examples of carboxylic acids having three or more carboxyl groups include trimellitic acid, 1,2,4-naphthalene tricarboxylic acid, hemimellitic acid, trimesic acid, mellophanic acid, prehnitic acid, pyromellitic acid, mellitic acid, 1,2,3,4-butanetetracarboxylic acid, acid anhydrides thereof, acid chlorides thereof, and lower alkyl esters having a carbon number of 1-3. Trimellitic acid and their anhydrides are particularly preferred. These carboxylic acids may be used alone or in combination.

A styrene-acrylic-modified polyester resin is composed of a polyester resin segment and a styrene-acrylic polymer segment, and these segments are linked to each other via monomers that can react with both polymers. The styrene-acrylic polymer segment is a moiety prepared by polymerizing an aromatic vinyl monomer and a (meth)acrylate ester monomer.

(Amorphous Resin Content)

The amorphous resin content in the binder resin is preferably 70 mass % or more. Such a content sufficiently improves the charge level. The upper limit of the styrene-acrylic resin content is not limited. Preferably, the amorphous resin content is 99 mass % or less, more preferably 80 mass % or less.

<Other Components>

The toner mother particle may contain any internal additive, for example, a release agent and a charge control agent, in addition to the binder resin and a colorant. The internal additive is a component contained inside the toner mother particle.

<Release Agent>

The toner mother particle may contain a release agent. A preferred release agent is a wax. Examples of the wax include hydrocarbon waxes, such as low-molecular-weight polyethylene waxes, low-molecular-weight polypropylene waxes, Fischer-Tropsch waxes, microcrystalline waxes, and paraffin waxes; and ester waxes, such as carnauba waxes, pentaerythritol behenate, behenyl behenate, and behenyl citrate. These release agents may be used alone or in combination.

The melting point of the wax is preferably in the range of 50 to 95° C. to certainly achieve the toner having low-temperature fixability and releasability. The wax content in the binder resin is preferably in the range of 2 to 20 mass %, more preferably 3 to 18 mass %, still more preferably 4 to 15 mass %.

Preferably, the wax forms a wax domain within the toner particles to exert releasability. The domain within the binder resin facilitates exertion of the binder resin's effects and the wax's effects. The major axis of the wax domain is preferably in the range of 100 nm to 1 μm. This range leads to a high level of releasability.

<Colorant>

The toner mother particle contains a colorant. Any known inorganic or organic colorant may be used. Examples include carbon blacks, magnetic materials, dyes, and pigments. Examples of carbon blacks include channel black, furnace black, acetylene black, thermal black, and lamp black. Examples of the magnetic materials include ferromagnetic metals, such as iron, nickel, and cobalt; alloys containing some of these metals; ferromagnetic metal compounds, such as ferrite and magnetite; alloys without a ferromagnetic metal and achieving ferromagnetism by a thermal treatment; Heusler alloys, such as manganese-copper-aluminum and manganese-copper-tin; and chromium dioxide.

Examples of black colorants include carbon blacks, such as furnace black, channel black, acetylene black, thermal black, and lamp black, and magnetic powders, such as magnetite powder and ferrite powder.

Examples of magenta or red colorants include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 150, C.I. Pigment Red 166, C.I. Pigment Red 177, C.I. Pigment Red 178, C.I. Pigment Red 184, and C.I. Pigment Red 222.

Examples of orange or yellow colorants include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, and C.I. Pigment Yellow 185.

Examples of green or cyan colorants include C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66, and C.I. Pigment Green 7.

These colorants may be used alone or in combination as needed.

The colorant content in the toner mother particle is, for example, in the range of 1 to 30 mass %, preferably in the range of 2 to 20 mass %. Such ranges lead to a sufficiently high image density and stability of the charge level.

<Charge Control Agent>

The toner mother particle may contain a charge control agent as needed. Any known charge control agents, such as compounds dispersible in an aqueous medium may be used. Examples include nigrosine dyes, metal salts of naphthenic acid or higher fatty acids, alkoxylated amines, quaternary ammonium salts, azo-metal complexes, and metal salts of salicylic acid and metal complexes thereof.

The charge control agent content in the binder resin is preferably in the range of 0.1 to 10 mass %, more preferably 0.5 to 5 mass %. Such ranges lead to rapid charge upon feeding of the toner.

Particles of the charge control agent have a number average primary particle diameter in the range of, for example, 10 to 1000 nm, preferably 50 to 500 nm, more preferably 80 to 300 nm.

[External Additive]

An external additive is added on the surface of the toner mother particle to improve chargeability, fluidity, and/or cleanability. The electrostatic image developing toner of the present invention contains, as the external additive, an inorganic fine particle having a number average major axis in the range of 50 to 100 nm, an average aspect ratio in the range of 3 to 10, and a volume resistivity in the range of $1\times10^{10}$ to $1\times10^{12}$ Ω·cm in primary particles.

<Inorganic Fine Particle>

(Number Average Major Axis of Inorganic Fine Particle of Present Invention)

The electrostatic image developing toner of the present invention contains the inorganic fine particle, as an external additive, having a number average major axis in the range of 50 to 100 nm in primary particles. Such a range of number average major axis in primary particles prevents the inorganic fine particle on the surface of the toner mother particle from the embedment and separation. In the case of a number average major axis of less than 50 nm, the inorganic fine particle is embedded in the surface of the toner mother particle and barely exerts its own functions. In the case of a number average major axis of more than 100 nm, the inorganic fine particle undesirably separates from the toner mother particle.

(Measurement of Number Average Major Axis and Minor Axis of Inorganic Fine Particle of Present Invention)

The number average major axis and minor axis of the inorganic fine particle of the present invention in primary particles are measured with an electron micrograph at a magnification of 50,000 taken with a scanning electron microscope (SEM) JEM-7401F (JEOL Ltd.). Specifically, a circumscribed rectangle having the smallest area is determined for each particle, and the number average major axis and the number average minor axis are calculated from the length of the longer sides and the length of the shorter sides of the circumscribed rectangles. Defining that rectangle 101 corresponds to inorganic fine particle 100, the number average major axis is calculated from the length of longer side 102 and the number average minor axis is calculated from the length of shorter side 103. The number average major axis and minor axis of the inorganic fine particle of the present invention are the averages of 100 inorganic fine particles (i.e., n=100).

(Average Aspect Ratio of Inorganic Fine Particle of Present Invention)

The average aspect ratio of the inorganic fine particle of the present invention is in the range of 3 to 10. The inorganic fine particle having such an average aspect ratio barely relocates across the surface of the toner mother particle because such a range leads to a large contact area between the inorganic fine particle and the toner mother particle, compared to titanium oxide having a small average aspect ratio. Consequently, the toner mother particle can be maintained to be evenly covered with the inorganic fine particle even when the toner mother particle undergoes strong stress, such as continuous agitation in a developing device. In the case of an average aspect ratio of less than 3, the contact area between the inorganic fine particle and the toner mother particle is small and the shape of the inorganic fine particle is close to spherical, resulted in ready embedment of the inorganic fine particle in the toner mother particle. In the case of an average aspect ratio of more than 10, the contact area between the inorganic fine particle and the spherical toner mother particle is small, resulted in ready separation of the inorganic fine particle from the toner mother particle.

Thus, the average aspect ratio of the inorganic fine particle of the present invention should be controlled within the range of 3 to 10.

(Measurement of Average Aspect Ratio of Inorganic Fine Particle of Present Invention)

The average aspect ratio of the inorganic fine particle of the present invention is a ratio of the above-defined number average major axis to the above-defined number average minor axis, i.e., (number average major axis)/(number average minor axis).

(Volume Resistivity of Inorganic Fine Particle of Present Invention)

The volume resistivity of the inorganic fine particle of the present invention is within the range of $1\times10^{10}$ to $1\times10^{12}$ Ω·cm. Titanium oxide, which has been used as an inorganic fine particle, can prevent excess charge of the toner in LL environments by virtue of its low resistivity. Unfortunately, in the case where a crystalline resin is used in the toner mother particle, titanium oxide decreases the resistivity of the overall toner. In contrast, the volume resistivity in the present invention is controlled to be lower than that, higher than $1\times10^{12}$ Ω·cm, of silica and is higher than that of existing titanium oxide, to prevent the excess charge of the toner in LL environments and retain the charge at a proper level in HH environments, which can reduce the fluctuation in charge level in different environments. In the case of using a crystalline resin-containing toner mother particle and an inorganic fine particle having a volume resistivity of less than $1\times10^{10}$ Ω·cm defined by the present invention, friction caused by mixing the toner and the carrier generates charge, but the generated charge is rapidly lost without retention. In contrast, use of the inorganic fine particle having a volume resistivity of $1\times10^{10}$ Ω·cm or more can retain the generated charge even when a crystalline resin-containing toner mother particle is used. Even when large amount of the toner is consumed and the inorganic fine particle relocates onto the surface of the carrier in the case of the high coverage rate, the carrier, on which the inorganic fine particle may exist, barely decreases its charge generating ability and the toner can retain its charge level, because the inorganic fine particle of the present invention facilitates generation and maintenance of the charge. In the case of a volume resistivity larger than $1\times10^{12}$ Ω·cm, the charge retaining effect is large and excess charge may be generated in LL environments. In addition, the charging speed of the toner decreases. Thus, the volume resistivity of the inorganic fine particle of the present invention should be controlled to be in the range of $1\times10^{10}$ to $1\times10^{12}$ Ω·cm. Use of the inorganic fine particle having a volume resistivity in the range of $1\times10^{10}$ to $1\times10^{12}$ Ω·cm leads to a stable charge level of the toner in various environments and/or coverage rates, and achieves stable output of high quality images under various conditions including HH environments and high coverage rates.

(Measurement of Volume Resistivity of Inorganic Fine Particle of Present Invention)

The volume resistivity of the inorganic fine particle of the present invention is measured through making pellets of the inorganic fine particle. Specifically, the inorganic fine particle is put in an environment at a temperature of 20° C. and a humidity of 50% RH overnight. In this environment, 0.5 to 1.0 g of inorganic fine particle is weighed and put into a jig, and a pressure of 1 ton is applied to the inorganic fine particle for 20 seconds to form pellets having a thickness of 2 mm±0.1 mm. The pellets are measured with TR8611A ULTRA HIGH RESISTANCE/LOW CURRENT METER made by ADVANTEST to determine the volume resistivity.

(Crystal Structure of Inorganic Fine Particle of Present Invention)

Any substance may be used as the inorganic fine particle of the present invention. To achieve preferred charge characteristics of the toner and a small distribution of the charge level, titanium oxide is preferred. Titanium oxide typically has a rutile or anatase structure. Rutile titanium oxide has a larger volume resistivity than anatase titanium oxide and facilitates the retention of the charge level. In addition, rutile titanium oxide readily dispersed across the surface of the toner, which achieves preferred charge characteristics of the toner and a small distribution of the charge level. Hence, rutile titanium oxide is particularly preferred.

Furthermore, rutile titanium oxide is prepared at a higher calcination temperature and thus has a smaller number of hydroxyl group on its surface than anatase titanium oxide. Thus, rutile titanium oxide is barely affected by humidity and ensures sufficient resistivity in various environments. External addition of rutile titanium oxide therefore achieves higher stability of the charge level in various environments.

(Preparation of Inorganic Fine Particle of Present Invention)

Methods of preparing titanium oxide used as the inorganic fine particle of the present invention will now be described.

Titanium oxide may be prepared by any known method, and examples include sulfuric acid processes, hydrothermal synthesis involving use of high temperature and pressure aqueous solvent, combustive decomposition of titanium tetrachloride, chemical treatments of hydrous titanium oxide, heating treatments, wet processes, and sol-gel processes.

A method of preparing the inorganic fine particle of the present invention is based on a sulfuric acid process involving dissolution of ilmenite in sulfuric acid to separate iron and hydrolysis of titanium oxysulfate ($TiOSO_4$) to form titanium oxide. For example, ilmenite ore is crushed and then reacts with sulfuric acid to convert ilmenite into water-soluble sulfate salt. The aqueous solution containing $TiOSO_4$ is left stand and filtrated to remove impurities, such as iron sulfate ($FeSO_4$). Subsequently, $TiOSO_4$ is hydrolyzed into titanium(II) hydroxide, which is an insoluble white precipitate. Titanium(II) hydroxide ($Ti(OH)_2$) is then neutralized, dried, calcined, and milled into the inorganic fine particle of the present invention. The sulfuric acid process generates anatase $Ti(OH)_2$, and crystals of anatase titania grow into needles. The phase transition of anatase titania to rutile titania occurs at about 900° C.

The particle size and shape of the inorganic fine particle of the present invention can be adjusted by varying the temperature, pH, and reaction time of the hydrolysis. The crystal structure of the inorganic fine particle of the present invention can be adjusted by varying the calcination temperature and calcination time.

(Surface Modification of Inorganic Fine Particle of Present Invention)

To hydrophobize the inorganic fine particle of the present invention, any known surface modifier may be used. Alkoxysilane coupling agents having an alkyl group and represented by general formula (1) [$R_1$—$Si(OR_2)_3$] are particularly preferred. In general formula (1), $R_1$ is a linear alkyl group that has a carbon number of 4-16 and optionally has a substituent, and $R_2$ is a methyl or ethyl group. Examples of the alkoxysilane coupling agents having the alkyl chain represented by general formula (1) include $CH_3$—$(CH_2)_3$—$Si(OCH_3)_3$, $CH_3$—$(CH_2)_3$—$Si(OC_2H_5)_3$, $CH_3$—$(CH_2)_5$—$Si(OCH_3)_3$, $CH_3$—$(CH_2)_5$—$Si(OC_2H_5)_3$, $CH_3$—$(CH_2)_7$—$Si(OCH_3)_3$, $CH_3$—$(CH_2)_7$—$Si(OC_2H_5)_3$, $CH_3$—$(CH_2)_9$—$Si(OCH_3)_3$, $CH_3$—$(CH_2)_9$—$Si(OC_2H_5)_3$, $CH_3$—$(CH_2)_{11}$—

$Si(OCH_3)_3$, $CH_3—(CH_2)_{11}—Si(OC_2H_5)_3$, $CH_3—(CH_2)_{13}—Si(OCH_3)_3$, $CH_3—(CH_2)_{13}—Si(OC_2H_5)_3$, $CH_3—(CH_2)_{15}—Si(OCH_3)_3$, and $CH_3—(CH_2)_{15}—Si(OC_2H_5)_3$.

The modification of the inorganic fine particle with the silane coupling agent having an alkyl group increases the volume resistivity of the inorganic fine particle of the present invention, which prevents a decrease in the charge level of the toner in environments and conditions that facilitate such a decrease, such as high temperature and humidity environments and high coverage rates. The increase in the volume resistivity may be achieved because the alkyl group functions as an insulation layer on the surface of the inorganic fine particle. The surface modification is preferred also because the alkyl chain of the coupling agent prevents the separation of the inorganic fine particle from the toner mother particle. This prevented separation may be achieved by tangle of the alkyl chains of the surface modifier and the polymer chains of the toner mother particle. In general formula (1), the carbon number of $R_1$ is in the range of 4 to 16, preferably 8 to 12. A carbon number less than 4 leads to low hydrophobicity and insufficient resistivity, resulted in an insufficient charge level in high temperature and humidity environments. In addition, a carbon number less than 4 leads to poor adhesion to the toner mother particle and ready separation from the toner mother particle. A carbon number larger than 16 leads to high agglomerability due to the presence of the surface modifier. Consequently, the external additive is hardly dispersed across the surface of the toner mother particle and the external additive particles readily separate from the toner mother particle, which hinders inherent charging ability of the external additive. In general formula (1), $R_2$ represents a methyl or ethyl group. A methyl group is preferred in terms of reactivity. In the case where $R_2$ is a functional group having a large steric structure, the surface modification of the surface of the toner mother particle is prevented. In the case where $R_2$ is a hydrogen atom, hydroxyl groups are present in the surface modifier. This unfortunately leads to high chemical affinity of the surface modifier to water and large leak of the charge level in high temperature and humidity environments.

Thermally treated rutile titanium oxide and a hydrophobizing agent are dissolved in a solvent suitable for the hydrophobizing agent, and then the solvent is stirred to progress reactions. The reaction product is precipitated by centrifugation and washed with an appropriate solvent, and then collected by the second centrifugation and dried under reduced pressure. The hydrophobized inorganic fine particle of the present invention is prepared in this way.

(Inorganic Fine Particle Content of Present Invention)

The inorganic fine particle content of the present invention is preferably in the range of 0.1 to 1.0 parts by mass relative to 100 parts by mass of the toner mother particle. A content of 0.1 parts by mass or more leads to proper coating of the toner mother particle and a high retention of the charge level. A content of 1.0 parts by mass or less leads to a minimal decrease in the charge level which is caused by the separation from the toner particles and relocation onto the surface of the carrier particle.

<Spherical Silica>

The electrostatic image developing toner of the present invention preferably contains a silica particle having a number average primary particle diameter in the range of 60 to 150 nm (hereinafter also referred to as a "spherical silica" or a "spherical silica particle"), as the external additive, in addition to the inorganic fine particle. When the toner undergoes stresses, such as agitation, a larger external additive readily separates from the surface of the toner mother particle while a smaller external additive is readily embedded in the toner mother particle. Thus, the external additive preferably has a desirable particle diameter and a small particle-size distribution, which reduce the embedment and separation of the external additive. A spherical silica having a number average primary particle diameter within the above range is larger than other external additives and exerts spacer effect in the two-component developer. This effect prevents embedment of other smaller external additives into the toner mother particle during agitation of the two-component developer in a developing device. A number average primary particle diameter of 60 nm or more leads to a high level of spacer effect which prevents embedment of small external additives at the surface of the toner. A number average primary particle diameter of 150 nm or less prevents the separation from the surface of the toner mother particle and a decrease in charging ability of the carrier due to the separation of the spherical silica. Hence, the number average primary particle diameter of the spherical silica is preferably within the range of 60 to 150 nm, more preferably 80 to 120 nm. The number average primary particle diameter of the spherical silica can be determined by a method mentioned in Examples described later.

(Preparation of Spherical Silica)

The spherical silica particle of the present invention may be prepared by any known method of preparing a spherical silica. In this case, the spherical silica particle of the present invention is prepared through the three main processes, i.e., hydrolysis, polycondensation, and hydrophobization, in combination with any other optional process, such as drying as needed.

In the present invention, preferred is a spherical silica prepared through a sol-gel process. A silica prepared through a sol-gel process has a larger diameter and a smaller particle-size distribution, i.e., higher monodispersity, than fumed silica prepared through generally-used processes. A high monodispersity enhances the spacer effect of the spherical silica in the two-component developer.

The spherical silica particle may be prepared by the following procedures. An alkoxysilane compound, for example, tetramethoxysilane or tetraethoxysilane, and ammonia as a catalyst are added dropwise with stirring at elevated temperature to water and an alcohol to prepare silica sol suspension. The silica sol suspension is then centrifuged and separated into wet silica gel, the alcohol phase, and the aqueous ammonia. The wet silica gel is mixed with solvent into silica sol again. A hydrophobizing agent is then added to the silica sol to modify the surface of the silica. Alternatively, the silica sol is dried into dry sol, and then a hydrophobizing agent is added to the dry sol to hydrophobize the surface of the silica.

Examples of the hydrophobizing agent include common silane coupling agents, silicone oils, fatty acids, and metallic salts of fatty acids. Subsequently, the solvent is removed from the resulting silica sol to yield the spherical silica particle of the present invention. This spherical silica particle may be subjected to a hydrophobization process again.

Other additional processes may be employed. Examples include: drying processes, such as spray drying, where a hydrophobizing agent or a solution containing a hydrophobizing agent is sprayed onto particles floating in a gas phase; wet processes where particles are soaked in a solution containing a hydrophobizing agent and then dried; and mixing processes where a hydrophobizing agent and particles are mixed in a mixer.

The hydrophobizing agent may be a water-soluble silane coupling agent. Examples include those represented by general formula (2) [$R_n$—Si—$X_{(4-n)}$].

In general formula (2), n represents an integer in the range of 0 to 3, R represents a hydrogen atom or an organic group, for example, an alkyl group or alkenyl group, and X represents a chlorine atom, or a hydrolyzable group, for example, a methoxy group or ethoxy group.

Examples of compounds represented by general formula (2) include chlorosilanes, alkoxysilanes, silazanes, and special silylating agents. Specific examples include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bis trimethylsilyl) acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane.

Preferred hydrophobizing agents used in the present invention include dimethyldimethoxysilane, hexamethyldisilazane (HMDS), methyltrimethoxysilane, isobutyltrimethoxysilane, and decyltrimethoxysilane.

Specific examples of the silicone oils include organosiloxane oligomers; cyclic compounds, such as octamethylcyclotetrasiloxane, decamethylcyclopentasiloxane, tetramethylcyclotetrasiloxane, and tetravinyltetramethylcyclotetrasiloxane; and linear or branched polyorganosiloxanes. Terminus-modified silicone oils may also be used. Nonlimiting examples of modifiable groups include alkoxy, carboxyl, carbinol, higher fatty acid, phenol, epoxy, methacryl, and amino groups. Silicone oils having multiple modified groups, such as modified amino and alkoxy groups, may also be used. Alternatively, a dimethyl silicone oil, a modified dimethyl silicone oil, and another hydrophobizing agent as needed, may be used in mixture or in combination. Examples of hydrophobizing agents that may be used in combination with a silicone oil include silane coupling agents, titanate coupling agents, aluminate coupling agents, silicone oils, fatty acids, metallic salts of fatty acids, esters thereof, and rosin acid.

The number average primary particle diameter of the spherical silica prepared through a sol-gel process may be adjusted to a desirable value by varying the amount of the alkoxysilane compound, catalyst, alcohol, and/or water, and by varying the reaction temperature, stirring rate, and/or feeding rate employed in the hydrolysis.

(Spherical Silica Content)

The spherical silica particle content should preferably be in the range of 0.6 to 2.0 parts by mass relative to 100 parts by mass of toner mother particle. A content of 0.6 parts by mass or more relative to 100 parts by mass of toner mother particle leads to proper coating of toner mother particle, a high level of spacer effect, significantly reduced adhesion of toner particles, and thus high cleaning effect and transfer characteristics. A content of 2.0 parts by mass or less relative to 100 parts by mass of toner mother particle can reduce instability of electric charge due to contamination of the carrier surface by spherical silica particles detached from the toner mother particle.

(Miscellaneous External Additive)

The electrostatic image developing toner of the present invention may further contain other external additives, such as known inorganic fine particles, organic particles, and lubricants, in addition to the inorganic fine particle having a predetermined number average major axis, a predetermined average aspect ratio, and a predetermined volume resistivity of the present invention. These external additives may be used alone or combination. The toner thereby has further improved fluidity, and cleaning and charging characteristics.

Examples of the inorganic fine particle include particles of silica, titanium oxide, alumina, zirconia, zinc oxide, chromium oxide, cerium oxide, antimony oxide, tungsten trioxide, tin oxide, tellurium oxide, manganese oxide, and boron trioxide. Preferred are silica, titanium oxide, alumina, and strontium titanate. The surface of the inorganic fine particle should preferably be subjected to hydrophobic treatment with any known surface modifier. The surface modifiers may be used alone or combination. Examples of the surface modifier include silane coupling agents, silicone oils, titanate coupling agents, aluminate coupling agents, fatty acids, metallic salts and esters of fatty acids, and rosin acids.

Examples of the silane coupling agent include dimethyldimethoxysilane, hexamethyldisilazane (HMDS), methyltrimethoxysilane, isobutyltrimethoxysilane, octyltrimethoxysilane, and decyltrimethoxysilane. Examples of the silicone oil include cyclic, linear, and branced polyorganosiloxanes, such as, polyorganosiloxane oligomers, octamethylcyclotetrasiloxane, decamethylcyclopentasiloxane, tetramethylcyclotetrasiloxane, and tetravinyltetramethylcyclotetrasiloxane.

The inorganic fine particle content may be appropriately variable. The content is preferably 70 to 90% on the basis of the surface coverage of the toner mother particle to maintain fluidity and thermal stability during preservation.

Usable organic particles are spherical organic particles having a number average primary particle diameter of about 10 to 2000 nm of homopolymers and copolymers of, for example, styrene and methyl methacrylate.

The lubricant is used to further improve cleaning and transfer characteristics. Examples of the lubricant salts of aluminum, copper, magnesium, calcium, manganese, and iron; and metal salts of higher fatty acids, such as zinc stearate, zinc oleate, zinc palmitate, zinc linolate, and zinc ricinolate.

<Production of Toner>

The toner can be produced by any known process. Examples of the process include kneading pulverization, suspension polymerization, emulsion aggregation, dissolution suspension, polyester stretching, and dispersion polymerization.

Among these processes preferred is emulsion aggregation in consideration of uniform particle diameter, shape control, and ease of formation of core-shell structure. The production of the toner by an emulsion aggregation process will now be described. Any other process may also be used in the invention.

(Emulsion Aggregation)

The emulsion aggregation is a process of forming a toner mother particle that involves mixing a dispersion of binder resin fine particles (hereinafter resin fine particles) dispersed with a surfactant and a stabilizer with a dispersion of, for example, a colorant, if necessary, and adding a flocculant to aggregate the particles until a predetermined toner diameter during or after fusing resin fine particles for shape control.

The resin fine particles may be composite particles consisting of two or more layers having different compositions.

The resin fine particles can be produce by, for example, emulsion polymerization, miniemulsion polymerization, phase inversion emulsification, or any combination thereof. Any internal additive is preferably added to resin fine particles by miniemulsion polymerization.

The internal additive may be added to the toner mother particle according to the following procedure: Resin fine particles containing the internal additive are used; or dispersion of internal additive fine particles is prepared and the internal additive fine particles are aggregated (associated) together with resin fine particles.

A toner mother particle having a core-shell structure can be produced by emulsion aggregation. In detail, binder resin fine particles for core particles and optional colorant fine particles are aggregated and fused to prepare core particles, and then binder resin fine particles for shell layers are added to the core particle dispersion to aggregate and fuse the binder resin fine particles for shell layers onto the surfaces of the core particles. Shell layers covering the surfaces of the core particles can thereby be formed.

In a preferred embodiment, the method of producing the toner by emulsion aggregation involves step (a) of preparing a binder resin fine particle dispersion, a crystalline resin fine particle dispersion, and a colorant dispersion (hereinafter referred to as a preparation step); step (b) of mixing the binder resin fine particle dispersion, crystalline resin fine particle dispersion, and colorant dispersion to aggregate and fuse them (hereinafter referred to as an aggregation and fusion step); step (c) of controlling the shape factor (circularity) of the toner (shape factor (circularity) controlling step); step (d) of filtering the toner mother particle from the dispersion of toner mother particle and removing surfactant and other impurities (filtering and washing step); step (e) of drying the toner mother particle (drying step); and step (f) adding an external additive to the toner mother particle (external additive adding step). These steps will now be described in detail.

(a) Preparation Step

Step (a) involves substeps of preparing a binder resin fine particle dispersion, preparing a crystalline resin fine particle dispersion, and optionally preparing a colorant dispersion, as described in detail below.

This step may also involve a substep of preparing a release agent dispersion. In the substep of preparing the binder resin fine particle dispersion or crystalline resin fine particle dispersion, a release agent may be added to the resin fine particles, such as the binder resin fine particles or crystalline resin fine particles. Alternatively, a dispersion of release agent fine particle may be separately prepared to be added in the aggregation and fusion step.

(a1) Substep of Preparing Binder Resin Fine Particle Dispersion

The substep of preparing a fine particle dispersion of binder resin containing amorphous resin involves synthesizing an amorphous resin and dispersing the amorphous resin in an aqueous media in the form of fine particles to forma dispersion of amorphous resin fine particles.

The production process of the amorphous resin, such as styrene-(meth)acrylic resin, or amorphous polyester resin, is manufactured as described above, and redundant description is omitted.

Examples of the method of dispersing the amorphous resin in an aqueous dispersion include Method (I) of forming amorphous resin fine particles from a monomer for preparing an amorphous resin while preparing an aqueous dispersion of the amorphous resin fine particles; and Method (II) of dissolving or dispersing an amorphous resin in organic solvent to prepare an oil phase solution, dispersing the oil phase solution into an aqueous dispersion medium by phase inversion emulsification, for example to form oil droplets having a desirable diameter, and then removing the organic solvent.

In Method (I), a monomer for preparing an amorphous resin and a polymerization initiator are added to an aqueous medium, and the monomer is polymerized to yield base particles. In the next stage, a radical polymerizable monomer and a polymerization initiator are preferably added to the dispersion of the resin fine particles to seed-polymerize the radical polymerizable monomer onto the base particles.

Usable polymerization initiators are water-soluble polymerization initiators. Examples of preferred water-soluble polymerization initiators include water-soluble radical initiators, such as potassium persulfate and ammonium persulfate.

The seed polymerization reaction system may contain a commonly used chain-transfer agent to control the molecular weight of the amorphous resin fine particles. Examples of such a chain-transfer agent include 2-chloroethanol; mercaptans, such as octylmercaptan, dodecylmercaptan, and t-dodecylmercaptan; n-octyl 3-mercaptopropionate, and stearyl 3-mercaptopropionate; and styrene dimer. The chain-transfer agent may be used alone or combination.

In Method (II), preferred organic solvents used for preparation of the oil phase solution have low boiling point and low miscibility with water in view of ease of removal after the formation of the oil droplets. Examples of such solvents include methyl acetate, ethyl acetate, methyl ethyl ketone, isopropyl alcohol, methyl isobutyl ketone, toluene, and xylene. These solvents may be used alone or in combination.

The organic solvent may be used in an amount (total amount in combined use) of usually 10 to 500 parts by mass, preferably 100 to 450 parts by mass, more preferably 200 to 400 parts by mass relative to 100 parts by mass of amorphous resin.

The aqueous medium is used in an amount of preferably 50 to 2,000 parts by mass, more preferably 100 to 1,000 parts by mass relative to 100 parts by mass of oil phase solution. Such a range on the amount of the aqueous medium facilitates dispersion of the oil phase solution into a desirable particle size distribution in an aqueous medium.

The aqueous medium may also contain a dispersion stabilizer, and a surfactant and resin fine particles to improve the dispersion stability of the oil droplets.

The emulsifying dispersion of the oil phase solution can be performed by mechanical energy. Nonlimiting examples of dispersers for emulsifying dispersion includes low speed shearing dispersers, high speed shear dispersers, friction type dispersers, high pressure jet type dispersers, ultrasonic dispersers such as ultrasonic homogenizers, and high pressure impact type disperser (Ultimizer).

After the formation of the oil droplets, the organic solvent may be removed by gradually heating the dispersion of the amorphous resin fine particles in the aqueous medium with stirring, vigorously stirring the dispersion at a predetermined temperature range, and then removing the solvent. Alternatively, the solvent may be removed under reduced pressure with an evaporator.

The amorphous resin fine particles (oil droplets) in the amorphous resin fine particle dispersion prepared by Method (I) or (II) have a volume-basis median diameter of preferably 60 to 1000 nm, more preferably 80 to 500 nm. The volume-basis average particle diameter is determined by the method described in Example. The volume average particle diameter can be controlled by the level of the mechanical energy during emulsifying dispersion.

The amorphous resin fine particle content in the amorphous resin fine particle dispersion is in the range of preferably 5 to 50 mass %, more preferably 10 to 30 mass %. Such a range leads to a narrow particle size distribution and improved toner characteristics.

(a2) Substep of Preparing Crystalline Resin Fine Particle Dispersion

The substep of preparing the crystalline resin fine particle dispersion involves synthesizing a crystalline resin, dispersing the synthetic crystalline resin in an aqueous medium into fine particles.

The crystalline resin such as a crystalline polyester resin can be manufactured as described above and redundant description is eliminated.

The crystalline resin fine particle dispersion may be prepared by, for example, performing organic-solvent-free dispersing treatment in an aqueous medium, or dissolving a crystalline resin in an solvent such as ethyl acetate, emulsifying and dispersing the solution in an aqueous medium with a disperser, and then removing the solvent.

The crystalline resin is dispersed in an aqueous medium by dissolving or dispersing the resin in an organic solvent to prepare an oil phase solution, dispersing the oil phase solution in an aqueous medium by, for example, phase inversion emulsification to form oil droplets having an intended particle diameter, and then removing the organic solvent.

The aqueous medium contains at least 50 mass % of water, and the component other than water is water-miscible organic solvent. Examples of the organic solvent include methanol, ethanol, 2-propanol, butanol, acetone, methyl ethyl ketone, dimethylformamide, methyl cellosolve, and tetrahydrofuran. Among them, preferred are alcoholic solvents, such as methanol, ethanol, 2-propanol, and butanol, which can dissolve no resin. Use of water alone is preferred as an aqueous medium.

The organic solvent used for preparation of the oil phase solution preferably has low boiling point and low miscibility with water in view of ease of removal after the formation of the oil droplets. Examples of such solvents include methyl acetate, ethyl acetate, methyl ethyl ketone, isopropyl alcohol, methyl isobutyl ketone, toluene, and xylene. These solvents may be used alone or in combination.

The organic solvent may be used in an amount (total amount in combined use) of usually 1 to 300 parts by mass, preferably 10 to 200 parts by mass, more preferably 25 to 100 parts by mass relative to 100 parts by mass of resin. Such a range is preferred to yield a dispersion of resin fine particles having a uniform particles-size distribution.

The oil phase solution may further contain ammonia or sodium hydroxide to ionize carboxy groups and to facilitate the emulsification in the aqueous phase.

The aqueous medium is used in an amount of preferably 50 to 2,000 parts by mass, more preferably 100 to 1,000 parts by mass relative to 100 parts by mass of oil phase solution. Such an amount of aqueous medium ensures emulsifying dispersion of the oil phase layer into an intended particle diameter in the aqueous medium. The aqueous medium in the present invention consist of 50 to 100 mass % water and 0 to 50 mass % water-soluble organic solvent. Examples of the water-soluble organic solvent include methanol, ethanol, 2-propanol, butanol, acetone, methyl ethyl ketone, and tetrahydrofuran. Preferred are alcoholic organic solvents, which can dissolve no crystalline resin (for example crystalline polyester resin). The aqueous medium may contain amine and/or ammonia.

The aqueous medium may contain a dispersion stabilizer and adequate amounts of surfactant and resin fine particles to improve dispersion of the oil droplets.

Any known dispersion stabilizer may be used. Examples include inorganic compounds, such as tricalcium phosphate, calcium carbonate, titanium oxide, colloidal silica, and hydroxyapatite. Since the dispersion stabilizer should be removed from the resulting toner mother particle, preferred is, for example, tricalcium phosphate, which is soluble in acid or alkali. Stabilizers decomposable with any enzyme may be preferred in the environmental view.

Examples of the surfactant include anionic surfactants, such as alkyl benzenesulfonate, alpha-olefin sulfonate, phosphate ester, sodium polyoxyethylene lauryl ether sulfate, and sodium alkyl diphenyl ether disulfonate; amine salts, such as alkylamine salts, aminoalcohol fatty acid derivatives, polyamine fatty acid derivatives, and imidazolines; quaternary ammonium salt cationic surfactants, such as alkyltrimethylammnonium salts, dialkyldimethylammonium salts, alkyldimethylbenzylammonium salts, pyridinium salts, alkylisoquinolinium salts, and benzethonium chloride; nonionic surfactants, such as fatty acid amide derivatives and polyhydric alcohol derivatives; and ampholytic surfactants, such as alanine, dodecyldi(aminoethyl)glycine, di(octyl aminoethyl)glycine, and n-alkyl-N,N-dimethylammonium betaine. Also usable are anionic surfactants having fluoroalkyl groups and cationic surfactants.

Examples of the resin fine particles for improvements in dispersion stability include fine particles of poly(methyl methacrylate) resins, polystyrene resins, and polystyrene-acrylonitrile resins.

Such emulsifying dispersion of the oil phase solution can be carried out by mechanical energy, and any disperser described in item (a1) above can also be used without limitation.

The dispersion should preferably be carried out while the solution is being heated. Any heating temperature is used and is usually about 50 to 90° C.

The organic solvent after the formation of oil droplets can be removed, for example, by gradually heating with stirring the dispersion of crystalline resin fine particles in aqueous medium, vigorously stirring the dispersion in a predetermined temperature range, and then removing the solvent. In alternative embodiment, the organic solvent may be removed under reduced pressure with an evaporator.

The crystalline resin fine particles (oil droplets) in the prepared crystalline resin fine particle dispersion should preferably have a volume average particle diameter of 60 to 1000 nm, more preferably 80 to 500 nm to ensure stable production of toner. The volume average diameter of the resin fine particles (oil droplets) can be determined with a laser diffraction/scattering particles-size analyzer (Microtrack particles-size distribution analyzer "UPA-150" (Nikkiso Co., Ltd.). The volume average diameter of the fine particles (oil droplets) can be controlled by the level of the mechanical energy during the emulsifying dispersion process.

The content of the crystalline resin fine particles (solid content) of the crystalline resin fine particle dispersion should preferably be in the range of 10 to 50 mass %, more preferably 15 to 40 mass % relative to 100 mass % dispersion. Such a range leads to a sharp particle-size distribution and improved toner characteristics.

(a3) Preparation of Colorant Fine Particle Dispersion

In the preparation substep of colorant fine particle dispersion, colorant (pigment) is dispersed in an aqueous medium into fine particles to prepare colorant fine particle dispersion.

The aqueous medium used in substep (a2) for dispersion of the crystalline resin can also be used in this substep. The aqueous dispersion may contain a surfactant and resin fine particles, for example, to improve the dispersion stability. The surfactant and resin fine particles have been described in substep (a2).

The colorant can be dispersed by mechanical energy. Any disperser described above can be used without limitation.

The colorant fine particles should preferably have a volume average particle size in the range of 10 to 300 nm, more preferably 100 to 250 nm. Such a range results in high color reproducibility.

The content of colorant fine particles in the colorant fine particle dispersion (solid content) should preferably ranges from 10 to 50 mass %, more preferably 10 to 40 mass %. Such a range ensures high color reproducibility.

(a4) Preparation of Release Agent Fine Particle Dispersion

The release agent fine particle dispersion substep is optional. The release agent is dispersed in an aqueous medium into fine particles to prepare a release agent fine particle dispersion.

The aqueous medium has been described in item (a2), and may contain surfactant and resin fine particles described in item (a2) to improve dispersion stability.

The release agent can be dispersed by mechanical energy. Any disperser can be used. Examples include low speed shearing dispersers, high speed shear dispersers, friction type dispersers, high-pressure jet type dispersers, ultrasonic dispersers such as ultrasonic homogenizers, high pressure impact type dispersers (Ultimizer), and high-pressure homogenizer. The release agent fine particles may be heated, if necessary, during the dispersion substep.

(b) Aggregation and Fusion Step

The aggregation and fusion step for forming a toner mother particle involves mixing a binder resin fine particle dispersion, a crystalline resin fine particle dispersion, an optional colorant fine particle dispersion, and other optional components, such as a release agent fine particle dispersion, slowly aggregating fine particles under balance between surface repulsion of fine particles by adjustment of pH and aggregation force by addition of electrolytic flocculant to associate fine particles under control of the average diameter and particle size distribution while heating with stirring the dispersion to fuse the fine particles into a controlled shape. The aggregation and fusion step may also use mechanical energy or heating means.

(b1) Aggregation Substep

The aggregation substep involves mixing the resulting dispersions and a surfactant, heating the mixture to a temperature higher than the glass transition temperature of the amorphous resin to form aggregated particles. The aggregated particles should preferably be formed in the agitated solution at a pH of 8 to 12 more preferably 9 to 11. Such a pH range leads to aggregation of fine particles having a sharp particle size distribution. The pH can be adjusted with, for example, hydrochloric acid, sulfuric acid, nitric acid, bicarbonates, aqueous ammonia, potassium hydroxide, sodium hydroxide, sodium carbonate, or potassium carbonate.

A salt as flocculant, such as alkali metal salt or salt containing Group 2 element, is added to the mixture, and the mixture is heated to a temperature higher than the glass transition temperature of the amorphous resin to promote the formation of aggregated particles (aggregated particles may be mutually fused at the same time).

In detail, the binder resin fine particle dispersion, crystalline resin fine particle dispersion, colorant fine particle dispersion, and an optional release agent fine particle dispersion are mixed, and then flocculant is added to the mixed dispersion to aggregate the binder resin fine particles, crystalline resin fine particles, and colorant fine particles (particles may be mutually fused at the same time). When aggregated particles are grown to a target size, a salt, such as sodium chloride, is added to terminate the aggregation.

Any flocculant may be used in the present invention, metal salts are preferred. Examples of the metal salt include salts of monovalent metals, i.e., alkali metals, such as sodium, potassium, and lithium monovalent metal; salts of divalent metals i.e., calcium, magnesium, manganese and copper; and salts of trivalent metals, i.e., iron and aluminum. Examples of actual salt include sodium chloride, potassium chloride, lithium chloride, calcium chloride, magnesium chloride, zinc chloride, copper sulfate, magnesium sulfate, and manganese sulfate. Among these salts preferred are salts of divalent metals. A small amount of divalent metal salt can accelerate aggregation. The metal salts may be used alone or in combination.

In the aggregation substep, it is preferred to shorten the standing time after the addition of the flocculant (the time until the start of heating) as much as possible. In detail, the dispersion should preferably be heated immediately after addition of the flocculant to a temperature higher than the glass transition temperature of the amorphous resin. A long standing time causes several problems, such as an instable state of aggregated particles, a fluctuated size distribution of the toner particles, and instable surface characteristics, although the reason for such phenomena is not clear. The standing time is usually within 30 minutes, preferably within 10 minutes. The flocculant can be added at any temperature, preferably at a temperature lower than the glass transition temperature of the binder resin. In detail, after addition of the flocculant, the dispersion should preferably be rapidly heated at a rate of 0.8° C./min or more. Although the upper limit of the heating rate is not limited, the heating rate is controlled at a rate of 15° C./min or less to prevent generation of course particles due to rapid fusion. After the dispersion for aggregation reaches a temperature higher than the glass transition temperature, the dispersion for aggregation is maintained to promote fusion at the temperature until the volume median diameter reaches 4.5 to 7.0 μm (first aging substep). While the shape factor (circularity) of the fine particles during the aging is being observed, the first aging substep is continued until the shape factor becomes preferably 0.920 to 1.000.

Such a process can effectively promote the aggregation and growth of the crystalline resin fine particles, amorphous resin fine particles, and colorant fine particles and fusion between fine particles (disappearance of interfaces between fine particles), resulting in improved durability of toner particles.

In order to prepare a binder resin of the core-shell structure, an aqueous dispersion of the resin (preferably the amorphous resin described above) for a shell layer is further added to aggregate and fuse the resin for the shell layer on the surfaces of the monolayer binder resin particles (core particles) in the first aging step. Binder resin particles having a core-shell structure are thereby produced. The formation of the shells is followed by heating of the reaction system to ensure aggregation and fusion of the shells on the surfaces of the core particles until the fine particles have an intended shape (second aging step). The second aging step is continued until the average circularity of the toner mother particle having a core-shell structure reaches the above-mentioned range.

When the aggregated particles are grown to a predetermined diameter, amorphous resin fine particles are further added to prepare toner composed of an aggregated particle core covered with the amorphous resin (core-shell particles). Before the further addition, a flocculant may be added or the pH is adjusted. If the core-shell particles are not formed, the following aggregation terminating substep may be carried out when the aggregated particles are grown to a predetermined diameter.

The aggregation should preferably be carried out at elevated temperature. When system is heated to a temperature above the fusion temperature, the fusion step also proceeds at the same time. The heating rate is preferably in the range of 0.1 to 5° C./min to achieve a sharp particle size distribution of the aggregate. The maximum or peak temperature is preferably in the range of 40 to 100° C. to achieve a sharp particle size distribution of the aggregate.

(b2) Aggregation Terminating Substep

When the average diameter of the aggregated particles determined with a Coulter counter or any other analyzer reaches a predetermined level, an aggregation terminator is added to stop the growth of the fine particles. The dispersion containing aggregated particles may be further heated with stirring if necessary.

Examples of the aggregation terminator include ethylenediamine tetra acetic acid (EDTA) and its alkali metal salts, such as sodium salt; Gluconal, sodium gluconate; potassium citrate and sodium citrate; nitrilotriacetate (NTA) salts, GLDA (commercially available L-glutamic acid N, N-diacetic acid); humic acid and fluvic acid; maltol and ethyl maltol; pentaacetic acid and tetraacetic acid; known water-soluble polymers having both carboxy groups and hydroxy groups (polyelectrolyte); and sodium hydroxide, potassium hydroxide, sodium chloride, and aqueous solution thereof. The aggregation terminating substep may also involves stirring as in the aggregation substep.

(b3) Fusion Substep

The fusion substep involves heating the reaction system to a predetermined fusion temperature after the aggregation terminating substep (b2) or during the aggregation substep (b1) to fuse aggregated particles into fused particles.

The fusion temperature in the fusion substep should preferably be the melting point or higher of the crystalline resin, more preferably be a temperature 0 to 20° C. higher than the melting point of the crystalline resin. The heating time is usually 0.5 to 10 h enough for fusion of the resin. The heating may be carried out until a predetermined shape factor (for example, about 0.96) that is determined with a flow particle image analyzer (for example, FPIA-2000, made by Hosokawa Micron Corporation).

In the aggregation and fusion step, a surfactant may be added to the aqueous medium to stabilize the dispersion of fine particles in the aggregation system.

After the fusion of the aggregation, the dispersion of the toner mother particle is cooled to yield fused particles. In the case of preparation of toner by an emulsion aggregation method, a circularity controlling step (c) is preferably performed before cooling after the aggregation and fusion step.

The cooling rate should preferably be 0.2 to 20° C./min, more preferably 2 to 20° C./min. Such a range is suitable for production of toner with smooth surface after cooling. Any cooling process can be employed, for example, cooling with refrigerant introduced from the exterior of the reaction vessel, or cooling with cooled water directly introduced in the reaction system.

(c) Shape Factor (Circularity) Controlling Step

In the case of production of toner by an emulsion aggregation method, a shape factor (circularity) controlling step is employed after the aggregation and fusion substep. The circularity controlling step involves heating the particles prepared by the aggregation and fusion substep. The shape factor (circularity) can be controlled by the heating temperature and retention time. A higher heating temperature or longer retention time enables the toner mother particles with a shape factor (circularity) closed to 1 to be produced. It is preferred that an excess heating temperature be avoided to prevent re-aggregation of the toner particle matrices. It is also preferred that an excess retention time be avoided for the same reason.

In order to achieve a shape factor (circularity) close to 1, the shape factor (circularity) controlling step is performed preferably at 70 to 95° C., more preferably 70 to 90° C. Any retention time may be employed at such a heating temperature, and heating may be performed until the shape factor (circularity) reaches a target value (close to 1). The shape factor (circularity) is controlled by measuring the shape factor (circularity) of particles with a volume median diameter of 2 μm or more with a circularity analyzer during the heating operation and determining whether the particles have a predetermined circularity. The volume medial diameter refers to a median diameter on the basis of volume determined with a precise particle size distribution analyzer based on the Coulter principle (for example, "Multisizer 3" made by Beckman Coulter, Inc.).

(d) Filtering and Washing Step

The filtering and washing step involves a filtering treatment that includes cooling the resulting toner mother particle dispersion to form cooled slurry, filtrating the toner mother particle by solid-liquid separation with a solvent such as water, and washing the filtered toner mother particle (cake) to remove the contaminant such as a surfactant. Examples of solid-liquid separation and washing include centrifugal separation, reduced-pressure filtration using an aspirator and/or a Nutsche, and filtration using a filter press, which may be used without restriction. A pH adjustment and pulverization may be optionally employed in the filtering and washing step. The washing step removes the contaminants such as surfactant and flocculant from the filtered toner mother particle. The washing treatment is carried out until the electric conductivity of the filtrate decreases to, for example, 5 to 10 μS/cm with water.

(e) Drying Step

The drying step involves drying the washed toner mother particle. Examples of the dryer used in the drying step includes ovens, spray dryers, vacuum freeze dryers, reduced-pressure dryers, ventilation dryers, static shelf dryers, mobile shelf dryers, compartment tray dryers, fluidized bed dryers, tumble dryers, agitation dryers, and stirring type dryers, which can be used without restriction. The water content of the toner particles (toner mother particle) determined by a Karl Fischer coulometric titration method is preferably 5 mass % or less, more preferably 2 mass % or less.

If the dried toner particle matrices are aggregated by weak particle attractive force, the aggregate may be clushed. Examples of the clushing machines includes mechanical disintegrators, such as jet mills, Comil®, Henschel mixers, coffee mills, and food processor.

(Volume Average Diameter of Toner Mother Particle)

The toner mother particle preferably has a small particle diameter for improving the image quality. The volume average particle diameter of the toner mother particle is preferably in the range of 2 to 8 μm in view of compatibility between charging characteristics and fluidity, and ease of development, transfer, and cleaning. The diameter of the toner mother particle is more preferably in the range of 4 to 7 μm.

(Average Circularity of Toner Mother Particle)

In the electrostatic image developing toner of the present invention, the toner mother particle preferably has an average circularity of 0.940 or more in view of fluidity, charging uniformity of toner particles and 0.975 or less in view of cleaning characteristics, where the average circularity is represented by following Formula 1:

average circularity=(the perimeter of a circle having the same projected area as that of the particle image)/(the perimeter of the projected image of the particle) (Formula 1):

The average circularity can be determined with, for example, an average circularity analyzer "FPIA-2100" (made by Sysmex). In detail, the toner mother particle is placed in a surfactant aqueous solution and is dispersed by ultrasonic agitation for one minutes, and the average circularity of 3000 to 10000 particles are determined in a proper particle density in a high pass filter (HPF) mode with the analyzer "FPIA-2100".

(f) External Additive Adding Step

The external additive adding step involves adding external additives, such as a charge control agent, inorganic fine particles, organic fine particles, and a lubricant onto the surface of the dried toner mother particle for improving fluidity, charging characteristics, and cleaning characteristics. The external additive is added with any known apparatus, for example, a turbular mixer, a Henschel mixer, a Nauta mixer, a V-shaped mixer, or a sample mill. The toner may be sorted with a screen so as to have a proper particles size distribution, if necessary.

<Two-Component Developer for Electrostatic Image>

The toner can be used in the form of a one-component magnetic toner containing magnetic material, a two-component developer for electrostatic image (hereinafter merely two-component developer) containing carrier particles, and single use of non-magnetic toner. Particularly preferred is a two-component developer containing the electrostatic image developing toner and carrier particles.

The two-component developer is prepared by mixing the toner particles and carrier particles such that the toner particle content (toner concentration) is 4.0 to 8.0 mass %. Examples of the mixing machine include Nauta mixers and W corn and V-type mixers.

Examples of preferred carrier of the two-component developer include known magnetic particles of metals, such as iron, ferrite, and magnetite, and alloys of these metals with other metals, such as aluminum and lead magnetic particle. Particularly preferred are ferrite particles.

The carrier particles of the present invention are composed of a magnetic material. For example, the carrier particles are categorized into coated type carrier particles having a magnetic core and a shell covering the core and resin dispersion type carrier particles composed of dispersion of a resin and fine powder of magnetic material. Carrier particles of a coated type are preferred which barely adhere on photoreceptors.

The core particles are composed of, for example, a magnetic material strongly magnetized in the direction of a magnetic field. The magnetic materials are used alone or combination. Examples of the material include ferromagnetic metals, such as iron, nickel, and cobalt, alloys and compounds containing these metals, and alloys exhibiting ferromagnetic characteristics after heat treatment.

Examples of ferromagnetic metals and compounds containing the metals include iron, ferrite represented by Formula (3): [$MO.Fe_2O_3$], and magnetite represented by Formula (4): [$MFe_2O_4$], where M in Formulae (3) and (4) is at least one monovalent or divalent metal selected from the group consisting of Mn, Fe, Ni, Co, Cu, Mg, Zn, Cd, and Li.

Examples of the alloy exhibiting ferromagnetic characteristics after heat treatment include Heusler alloys, such as manganese-copper-aluminum and manganese-copper-tin, and chromium dioxide.

Preferably the core particles are composed of ferrite. Since the specific gravity of the coated type carrier particles is smaller than the specific gravity of the core particle metal, the core-shell structure can reduce impact force occurring agitation in the developing vessel.

The shell material may be any known resin that is used for covering the cores of the carrier particles. The shell material is preferably a resin having a cycloalkyl group that can reduce moisture adsorption of the carrier particles and enhance adhesiveness of the shell layers to the core particles. Examples of the cycloalkyl group include cyclohexyl, cyclopentyl, cyclopropyl, cyclobutyl, cycloheptyl, cyclooctyl, cyclononyl, and cyclodecyl groups. Among these groups preferred are cyclohexyl and cyclopentyl groups. More preferred is a cyclohexyl group in view of adhesiveness of the shell layers to the ferrite particles. The resin has a weight-average molecular weight Mw of, for example, 10,000 to 800,000, more preferably 100,000 to 750,000. The resin has a cycloalkyl group content of, for example, 10 mass % to 90 mass %. The cycloalkyl group content of the resin can be determined, for example, pyrolysis gas chromatography-mass spectrometry (P-GC/MS) and $^1$H-NMR.

The volume average particle diameter of the carrier is preferably in the range of 15 to 100 μm, more preferably 25 to 80 μm.

EXAMPLES

The present invention will now be described in further detail byway of examples, which should not be construed to limit the present invention. In the following examples, "part(s)" and "%" indicate "parts by mass" and "mass %", respectively, unless otherwise specified. Each operation was carried out at room temperature (25° C.), unless otherwise specified.

[Preparation of Inorganic Fine Particle of the Present Invention]

[Preparation of Inorganic Fine Particle 1]

(1) In a 2-L reactor provided with a stirrer, a dropping funnel, and a thermometer, 500 parts by mass of 10 mass % titanyl sulfurate solution was neutralized with 0.5 mass % diluted sodium carbonate alkaline solution to pH 9.5, and the solution was filtered to yield white precipitate.

(2) Pure water was added to the white precipitate and the mixture was heated at 90° C. for 1.5 h for hydrolysis, and was filtered to recover titanium oxide.

(3) The titanium oxide product was heated at 900° C. for 5 h in air in a high-temperature electric furnace, and then was cooled to room temperature, to yield rutile titanium dioxide. The product was pulverized with an agate mortar to prepare rutile titanium dioxide particles with a number average major axis of 50 nm and an average aspect ratio of 5.0.

(4) Into a 2-L reactor provided with a stirrer, a dropping funnel, and a thermometer was placed the resulting rutile titanium dioxide particles (50 g) and 0.7 parts by mass of octyltrimethoxysilane, and the mixture was stirred in 1.5 L toluene for 10 h for surface modification. After the reaction solvent was washed, the solid component was recovered by centrifugal separation, dried under reduced pressure, and pulverized to prepare inorganic fine particle 1 treated with a surface modifier.

Inorganic fine particle 1 has a volume resistivity of $1.4\times10^{11}$ Ω·cm.

[Preparation of Inorganic Fine Particles 2 to 8]

Inorganic fine particles 2 to 8 described in TABLE 1 were prepared as in preparation of inorganic fine particle 1, except that the pH, thermal reaction time, reaction temperature, type and amount of the surface modifier were varied to control the number average major axis, average aspect ratio, and volume resistivity. The volume resistivity was controlled by adjusting the amount of the surface modifier.

TABLE 1

| Inorganic fine particle No. | Aspect ratio | Major diameter [nm] | Surface modifier | Volume resistivity [Ω · cm] |
|---|---|---|---|---|
| 1 | 5.0 | 50 | Octyltrimethoxysilane | $1.4 \times 10^{11}$ |
| 2 | 5.0 | 50 | Octyltrimethoxysilane | $3.0 \times 10^{10}$ |
| 3 | 5.0 | 50 | Octyltrimethoxysilane | $9.0 \times 10^{11}$ |
| 4 | 3.5 | 60 | Isobutyltrimethoxysilane | $1.2 \times 10^{10}$ |
| 5 | 9.3 | 100 | Octyltrimethoxysilane | $2.0 \times 10^{11}$ |
| 6 | 5.0 | 50 | Octyltrimethoxysilane | $2.5 \times 10^{9}$ |
| 7 | 1.2 | 30 | Octyltrimethoxysilane | $8.5 \times 10^{10}$ |
| 8 | 5.0 | 120 | Octyltrimethoxysilane | $6.8 \times 10^{10}$ |

[Preparation of Spherical Silica]

[Preparation of Spherical Silica 1]

(1) Into 3-L reactor provided with a stirrer, a dropping funnel, and a thermometer were placed and mixed 630 parts by mass of methanol and 90 parts by mass of water. While the solution was being stirred, 950 parts by mass of tetramethoxysilane was added and hydrolyzed to produce slurry or suspension of silica particles. The system was heated to 60 to 70° C. to remove 390 parts of methanol, to yield aqueous slurry or dispersion of silica particles.

(2) To the aqueous slurry or suspension, 11.6 parts by mass of methyltrimethoxysilane (0.1 molar equivalent of tetramethoxysilane) was added dropwise at room temperature to hydrophobilize the surfaces of the silica particles.

(3) To the resulting dispersion, 1400 parts by mass of methyl isobutyl ketone was added, and the dispersion was heated to 80° C. to remove aqueous methanol. To the dispersion, 280 parts by mass of hexamethyldisilazane was added at room temperature, and was reacted at 120° C. for 3 h to trimethylsilylate the silica particles. The solvent was removed under reduced pressure to yield spherical silica particle 1.

Spherical silica particle 1 had a number average primary particle diameter of 100 nm.

[Preparation of Spherical Silicas 2 to 5]

Spherical silica particles 2 to 5 with number average diameters described in TABLE 2 were prepared as in preparation of spherical silica 1, except that the amounts of tetramethoxysilane and hexamethyldisilazane were varied to adjust the concentration of the reagent in the reaction system. As the reagent concentration increases, the number average primary particle diameter of the spherical silica increases. In contrast, as the reagent concentration decreases, the number average primary particle diameter of the spherical silica decreases.

TABLE 2

| Spherical silica No. | Diameter [nm] |
|---|---|
| 1 | 100 |
| 2 | 60 |
| 3 | 140 |
| 4 | 40 |
| 5 | 200 |

[Preparation of Toner]

[Preparation of Colorant Fine Particle Dispersion]

While a solution of 11.5 parts by mass of sodium n-dodecyl sulfate in 160 parts by mass of deionized water was being stirred, 24.5 parts by mass of copper phthalocyanine (C.I. Pigment Blue 15:3) was gradually added to the solution. The mixture was subjected to dispersion treatment with an agitator "CLEARMIX W motion CLM-0.8" (M Technique Co. Ltd.,) to prepare colorant fine particle dispersion 1 having a volume median diameter of 126 nm.

[Preparation of Binder Resin Fine Particle Dispersion 1]

(First-Stage Polymerization)

Into a reaction vessel provided with a stirrer, a thermosensor, a cooling tract, and a nitrogen inlet, 4 parts by mass of polyoxyethylene (2) dodecyl ether sodium sulfate and 3000 parts by mass of deionized water was fed, and the internal temperature was raised to 80° C. while the mixture was stirred at a rate of 230 rpm in a nitrogen stream. After the heating, a solution of 10 parts by mass of potassium persulfate in 200 parts by mass of deionized water was added. At a solution temperature of 75° C., a mixed monomer solution consisting of:

| | |
|---|---|
| styrene | 584 parts by mass, |
| n-butyl acrylate | 160 parts by mass, and |
| methacrylic acid | 56 parts by mass |

was added dropwise over 1 h, and was heated with stirring at 75° C. for 2 h for polymerization. Dispersion of resin fine particles b1 was thereby prepared.

(Second-Stage Polymerization)

Into a reaction vessel provided with a stirrer, a thermosensor, a cooling tract, and a nitrogen inlet, 2 parts by mass of polyoxyethylene (2) dodecyl ether sodium sulfate and 3000 parts by mass of deionized water were fed, and the solution was heated to 80° C. After the heating, a solution of 42 parts by mass of resin fine particles b1 (solid content) and 70 parts by mass of microcrystalline wax "HNP-0190" (made by Nippon Seiro Co., Ltd.) were dissolved in a monomer mixture consisting of:

| | |
|---|---|
| styrene | 239 parts by mass, |
| n-butyl acrylate | 111 parts by mass, |
| methacrylic acid | 26 parts by mass, and |
| n-octyl mercaptan | 3 parts by mass |

at 80° C., and the mixture was dispersed for 1 h in a mechanical disperser "CLEARMIX" (made by M Technique Co., Ltd.) with a circulation pathway. Dispersion containing emulsified particles (oil droplets) was thereby prepared.

After an initiator solution of 5 parts by mass of potassium persulfate in 100 parts by mass of deionized water was added to the dispersion, the system was heated with stirring at 80° C. for 1 h for polymerization. Dispersion of resin fine particles b2 was thereby prepared.

(Third-Stage Polymerization)

A solution of 10 parts by mass of potassium persulfate in 200 parts by mass of deionized water was added to the dispersion of resin fine particles b2, and a monomer mixture consisting of:

| | |
|---|---|
| styrene | 380 parts by mass, |
| n-butyl acrylate | 132 parts by mass, |
| methacrylic acid | 39 parts by mass, and |
| n-octyl mercaptan | 6 parts by mass |

was added dropwise over 1 h at 80° C. After dropwise addition, the solution was heated with stirring for 2 h for polymerization, and then was cooled to 28° C., to prepare binder resin fine particle dispersion 1.

[Synthesis of Crystalline Resin 1]

In a reaction vessel provided with a nitrogen inlet, a dehydration tract, a stirrer, and a thermocouple, 220 parts by mass of sebacic acid (molecular weight 202.25) as a polyvalent carboxylic acid compound and 298 parts by mass of 1,12-dodecanediol (molecular weight 202.33) as a polyhydric alcohol compound for a polyester polymerization segment were heated to 160° C. to dissolve the content. Then, 2.5 parts by mass of tin (II) 2-ethylhexanoate and 0.2 parts by mass of gallic acid were added and the mixture was heated to 210° C. for 8 h for reaction and then 1 h under a pressure of 8.3 kPa to prepare crystalline resin 1.

The differential scanning calorimetry of crystalline resin 1 was carried out at a heating rate of 10° C./min with a differential scanning calorimeter "Diamond DSC" (PerkinElmer Japan), and the melting point (Tm) of the resin was determined to be 82.8° C. from the peak temperature of the DSC endothermic curve. The polystyrene equivalent molecular weight Mw determined with a GPC "HLC-8120GPC" (made by Tosoh Corporation) was 28000.

[Preparation of Crystalline Resin Fine Particle Dispersion 1]

Crystalline resin 1 (100 parts by mass) was dissolved in ethyl acetate (400 parts by mass). Then, 5.0 mass % aqueous sodium hydroxide solution (25 parts by mass) was added to the solution to prepare a resin solution. The resin solution was placed into a vessel with a stirrer, and, aqueous 0.26 mass % sodium lauryl sulfate solution (638 parts by mass) was added dropwise over 30 min while the resin solution was being stirred. During addition of the aqueous sodium lauryl sulfate solution, the solution in the reaction vessel became cloudy. After the dropwise addition of all the aqueous sodium lauryl sulfate solution, homogeneous emulsion of resin particles was prepared. The emulsion was heated to 40° C., and ethyl acetate was removed by distillation under a reduced pressure of 150 h Pa with a diaphragm vacuum pump "V-700" (made by BUCHI) to give crystalline resin fine particle dispersion 1 composed of crystalline polyester resin.

[Preparation of Toner Mother Particle 1]

(Aggregation and Fusion Step)

A reaction vessel provided with a stirrer, a thermosensor, a cooling tract, and a nitrogen inlet was loaded with 300 parts by mass (solid basis) of binder resin fine particle dispersion 1, 60 parts by mass (solid basis) of crystalline resin fine particle dispersion 1, 1100 parts by mass of deionized water, 40 parts by mass (solid basis) of colorant fine particle dispersion 1, the solution was maintained at 30° C., and then 5N aqueous sodium hydroxide solution was added to adjust pH at 10. An aqueous solution of 60 parts by mass of magnesium chloride in 60 parts by mass of deionized water was gradually added over 10 min to the stirred solution at 30° C. After 3 min, the system was slowly heated to 85° C. over 60 min, and aggregation of particles was continued at 85° C. In this state, the diameter of the aggregated particles was determined with "Coulter Multisizer 3" (made by Beckman Coulter, Inc.). When the volume median diameter reached 6 μm, an aqueous solution of 40 parts by mass of sodium chloride in 160 parts by mass of deionized water was added to terminate the growth of the particles, and the particles were aged at 80° C. for 1 h with stirring to facilitate fusion between particles. Dispersion of toner mother particle 1 was thereby prepared.

(Washing and Drying Step)

The toner mother particle product was solid-liquid separated with a Basket-type centrifuge "MARK III type 60×40+M" (Matsumoto Machine Mfg. Co., Ltd.) to yield wet cake of the toner mother particle. The cake was washed with deionized water at 40° C. in the Basket-type centrifuge until the electric conductivity of the filtrate became 5 μS/cm, and then was dried in a flash jet drier (made by Seishin Enterprise Co., Ltd.) into a water content of 0.5 mass %, to prepare toner mother particle 1.

[Preparation of Toner Mother Particle 2 (not Containing Crystalline Resin)]

Toner mother particle 2 was prepared as in production of toner mother particle 1, except that no crystalline polyester resin was used in the toner mother particle.

(Calculation of Crystalline Resin Content in Toner Mother Particle)

In the embodiment, the crystalline resin content (%) in the toner mother particle was calculated from the following expression (solid basis):

Crystalline resin content (%) in toner mother particle=(amount of crystalline resin (parts by mass))/{(amount of binder resin (parts by mass))+(amount of crystalline resin (parts by mass))+(amount of colorant (parts by mass))}×100

The crystalline resin (crystalline polyester) contents of the resulting toner particle matrices are shown in TABLE 3.

TABLE 3

| Toner mother particle No. | Crystalline resin content [%] |
|---|---|
| 1 | 10 |
| 2 | 0 |

(External Additive Adding Step)

Preparation of Toner Particle 1)

The following external additives are added to toner mother particle 1 or 2 (100 parts by mass) and the mixture is stirred for 25 minutes at a circumferential speed of 40 m/s of blades in a Henschel mixer type "FM20C/I" (NIPPON COKE & ENGINEERING CO., LTD.) to prepare toner 1. The temperature of the mixed powder during the addition of the external additive was set at 40±1° C.

Additives:

| | |
|---|---|
| Inorganic fine particle 1 | 0.4 parts by mass, |
| Spherical silica 1 | 1.0 parts by mass, and |
| Fine silica (H1303 made by Clariant, number average primary particle diameter: 20 nm) | 0.6 parts by mass. |

[Preparation of Toner Particles 2 to 13]

Toner particles were prepared based on combinations shown in TABLE 4 as in preparation of toner particle 1.

TABLE 4

| Toner | | Spherical silica | | Inorganic fine particle | | | |
|---|---|---|---|---|---|---|---|
| Toner particle No. | mother particle No. | No. | Diameter [nm] | No. | Volume resistivity [Ω · cm] | Aspect ratio | Major diameter [nm] |
| 1 | 1 | 1 | 100 | 1 | $1.4 \times 10^{11}$ | 5.0 | 50 |
| 2 | 1 | 2 | 60 | 1 | $1.4 \times 10^{11}$ | 5.0 | 50 |
| 3 | 1 | 3 | 140 | 1 | $1.4 \times 10^{11}$ | 5.0 | 50 |
| 4 | 1 | 1 | 100 | 2 | $3.0 \times 10^{10}$ | 5.0 | 50 |
| 5 | 1 | 1 | 100 | 3 | $9.0 \times 10^{11}$ | 5.0 | 50 |
| 6 | 1 | 1 | 100 | 4 | $1.2 \times 10^{10}$ | 3.5 | 60 |
| 7 | 1 | 1 | 100 | 5 | $2.0 \times 10^{11}$ | 9.3 | 100 |
| 8 | 1 | 4 | 40 | 1 | $1.4 \times 10^{11}$ | 5.0 | 50 |
| 9 | 1 | 1 | 100 | 6 | $2.5 \times 10^{9}$ | 5.0 | 50 |
| 10 | 1 | 5 | 200 | 1 | $1.4 \times 10^{11}$ | 5.0 | 50 |
| 11 | 1 | 1 | 100 | 7 | $8.5 \times 10^{10}$ | 1.2 | 30 |
| 12 | 1 | 1 | 100 | 8 | $6.8 \times 10^{10}$ | 5.0 | 120 |
| 13 | 1 | 1 | 100 | 1 | $1.4 \times 10^{11}$ | 5.0 | 50 |

[Preparation of Carrier Particles]

[Preparation of Core-Covering Resin (Shell Material 1)]

Cyclohexyl methacrylate and methyl methacrylate (molar ratio 1:1) was added to aqueous 0.3 mass % sodium benzenesulfonate solution, and potassium persulfate was added in an amount of 0.5 mass % of the total amount of monomers to proceed emulsion polymerization. The resin fine particles in the resulting dispersion were spray-dried to yield shell material 1 as a core-covering resin. Shell material 1 had a weight average molecular weight Mw of 500000, which were determined by gel permeation chromatography (GPC) as in crystalline polyester resin (B1).

[Preparation of Carrier Particles]

Mn—Mg ferrite particles having a volume average diameter of 30 μm were provided as core particles. The ferrite particles (100 parts by mass) and shell material 1 (4.5 parts by mass) were placed in a high-rate stirring mixer provided with a horizontal stirring blade and were mixed with stirring at a peripheral velocity of 8 m/sec of the stirring blade at 22° C. for 15 minutes. The system was further mixed at 120° C. for 50 minutes to cover the core particles with shell material 1 by the effect of mechanical impact (mechanochemical process). Carrier particle 1 was thereby prepared. Carrier particle 1 had a volume median diameter of 32 μm.

[Preparation of Two-Component Developers 1 to 13]

Each of toner particles 1 to 13 shown in TABLE 4 and carrier particle 1 (1.5 kg in total) were weighed such that the toner particle content (concentration) in the two component developer was 6.5 mass %, and were mixed in a V-shaped mixer for 30 minutes to prepare two-component developers 1 to 13.

<Number Average Major Axis of Inorganic Fine Particle and Number Average Primary Particle Diameter of Spherical Silica of the Present Invention>

The diameters of primary particles were determined on a photograph at a magnification of 50,000 taken with a scanning electron microscope (SEM) "JEM-7401F" (made by JEOL), the average of 20 particles was defined as a number average primary particle size. The number average major axis and minor axis of the primary particles of the inorganic fine particle in the present invention were measured. In detail, a rectangle circumscribing each particle and having a minimum area is determined by calculation, the lengths of the long and short sides of the rectangle are defined as a major axis and a minor axis, respectively, and the number average major axis and minor axis were determined. As shown in FIG. 1, the major axis and the minor axis of the inorganic fine particle 100 of the present invention were defined by the lengths of the long side and short side, respectively, of the rectangle circumscribing the particle. The number average major axis and minor axis of the inorganic fine particle of the present invention were determined from 100 particles.

<Average Aspect Ratio of Inorganic Fine Particle of the Present Invention>

The ratio of the number average major axis to the number average minor axis (number average major axis)/(number average minor axis) was defined as the average aspect ratio.

<Volume Resistivity of Inorganic Fine Particle of the Present Invention>

The volume resistivity was measured with a pelletized inorganic fine particle of the present invention. The inorganic fine particle was left to stand overnight at a temperature of 20° C. and a humidity of 50% RH, and 0.5 to 1.0 g of inorganic fine particle was placed into a pelletizing tool and was compressed under a pressure of 1 t for 20 seconds to prepare a compressed pellet with a thickness of 2 mm±0.1 mm. The resistivity of the pellet was determined with TR8611A ULTRA HIGH RESISTANCE/LOW CURRENT METER made by ADVANTEST.

<Determination of Melting Point of Crystalline Polyester Resin>

The melting point of the crystalline polyester resin was determined with a differential thermal analyzer (DSC). In detail, the melting point was determined with a differential scanning calorimeter "Diamond DSC" (made by PerkinElmer Co., Ltd.) under a temperature program, i.e., a first heating step of heating the sample from 0° C. to 200° C. at a heating rate of 10° C./min, a cooling step of cooling the sample from 200° C. to 0° C. at a cooling rate of 10° C./min, and then a second heating step of heating the sample from 0° C. to 200° C. at a heating rate of 10° C./min. The peak temperature of the endothermic DSC curve in the first heating step of the crystalline polyester resin was defined as a melting point. In the procedure, 4.5 mg of crystalline polyester resin was placed in an aluminum pan, and the aluminum pan was sealed and placed on the sample holder of "Diamond DSC". An empty aluminum pan was used as a reference.

The device used for evaluation was a commercially available digital full-color copying machine "Bizhub® PRO C6500" (made by Konica Minolta Japan Inc.).

[Evaluation 1: Low Temperature Fixability]

The fixing unit of the copying machine "bizhub PRO C6500" (Konica Minolta Japan Inc.) was modified such that the surface temperature of the heat roller for fixation was variable within a range of 100 to 210° C. Each of two-component developers 1 to 13 was loaded to the machine. A solid image with a deposited toner density of 11 mg/10 $cm^2$ was fixed onto size A4 plain paper (grammage: 80 $g/m^2$) at different temperatures every 1° C. from 140° C. to 200° C. The least fixing temperature at which no image contamination due to low-temperature offset was visually observed was determined to be a minimum fixing temperature. A lower minimum fixing temperature indicates excellent low-temperature fixability, and a lower temperature of less than 160° C. was an acceptable level.

Criteria for Evaluation

A: Minimum fixing temperature of less than 155° C.,

B: Minimum fixing temperature in a range of 155° C. to less than 160° C.,

C: Minimum fixing temperature of 160° C. or more.

[Evaluation 2: Thermal Storage Stability]

Toner (0.5 g) was placed in a 10-ml glass vial with an inner diameter of 21 mm, and the vial was covered with a lid and shaken 600 times at room temperature with a tap denser KYT-2000 (made by Seishin Enterprise Co., Ltd.). After the lid was removed, the vial was left to stand for 2 h in an environment of 55° C. and 35% RH. The toner was carefully placed on a 48-mesh (opening: 350 μm) screen not so as to disintegrate the toner aggregate, and the screen was mounted to a powder tester (made by Hosokawa Micron Corporation) and fixed with a pressure bar and a knob nut. After vibrations with an intensity of reciprocal width of 1 mm were applied for 10 seconds, the residual toner (mass %) on the screen was determined.

The toner aggregation rate was determined by the following expression:

$$(\text{Toner aggregation rate } (\%))=\{(\text{Mass (g) of toner remaining on screen})/0.5\ (\text{g})\}\times 100$$

The resistance of the toner against high-temperature storage was evaluated based on the following criteria:

A: toner aggregation rate<15 mass % (significantly high resistance of toner against high-temperature storage)

B: 15 mass %≤toner aggregation rate≤20 mass % (high resistance of toner against high-temperature storage)

C: 20 mass %<toner aggregation rate (low resistance of toner against high-temperature storage, unacceptable)

[Evaluation 3: Charge Level Stability (Environmental Stability)]

A solid strip test image with a printing rate of 5% was printed on five sheets of size A4 high-quality paper (65 g/m$^2$) under a low-temperature, low-humidity environment (temperature: 10° C., humidity: 20% RH) with a copying machine "bizhub PRO C6500" (Konica Minolta Japan Inc.), and the charge level of toner was determined.

The solid strip test image with a printing rate of 5% was also printed on five sheets of size A4 high-quality paper (65 g/m$^2$) under a high-temperature, high humidity environment (temperature: 30° C., 80% RH), and the charge level of toner was determined.

The two-component developer in the developing unit was sampled and the charge level was determined with a blow-off charge level measuring device "TB-200" (Toshiba Chemical's products). A smaller difference Δ in charge level after five-sheet printing between the low-temperature, low-humidity environment and the high-temperature, high-humid environment (hereinafter environmental difference Δ) indicates the toner is insulated from the environmental influence and has stable charge level. A charge level less than 15 μC/g was determined to be practical level. The environmental difference Δ was used for evaluation of the stability of charge level (environmental stability) based on the following criteria:

—Criteria—

(Environmental Difference Δ)

A: Environmental difference Δ in charge level of toner after five sheet printing under low-temperature, low-humidity environment and the high-temperature, high-humid environment was less than 10 μC/g, B: Environmental difference Δ in charge level of toner after five sheet printing under low-temperature, low-humidity environment and the high-temperature, high-humid environment was 10 μC/g or more and less than 15 μC/g, C: Environmental difference Δ in charge level of toner after five sheet printing under low-temperature, low-humidity environment and the high-temperature, high-humid environment was 15 μC/g or more.

[Evaluation 4: Charge Stability (Stability of Coverage Rate)]

Solid strip test images with a printing rate of 1% and 45%, respectively, were printed on 10,000 sheets of size A4 plain paper under a high-temperature, high-humidity environment (temperature: 30° C., humidity: 80% RH) with a copying machine "bizhub PRO C6500" (Konica Minolta Japan Inc.), and the charge level of toner were determined as in Evaluation 3. A lower variation Δ in charge level of toner after printing of 10,000 sheets of size A4 plain paper at a printing rate of 1% and 45% (referred to as a variation Δ in charge level due to a change in coverage rate) indicates a stable toner output. A variation of less than 10 μC/g was determined to be a practical level. The variation Δ in charge level stability of the charge level due to a change in coverage rate was used for evaluation of stability of charge level (stability of coverage rate) according to the following criteria:

—Criteria—

(Variation Δ in Charge Level Stability of Charge Level Due to Change in Coverage Rate)

A: A variation Δ in charge level stability of the charge level due to a change in coverage rate after printing of 10,000 sheets at a coverage rate of 1% and 45% under a high-temperature, high-humidity environment was less than 5 μC/g, B: A variation Δ in charge level stability of the charge level due to a change in coverage rate after printing of 10,000 sheets at a coverage rate of 1% and 45% under a high-temperature, high-humidity environment was 5 μC/g or more and less than 10 μC/g, C: A variation Δ in charge level stability of the charge level due to a change in coverage rate after printing of 10,000 sheets at a coverage rate of 1% and 45% under a high-temperature, high-humidity environment was 10 μC/g or more.

The results are shown in TABLE 5.

TABLE 5

| | Toner | Crystalline | Spherical silica | | Inorganic fine particle | | | | Evaluation Item | | | | |
|---|---|---|---|---|---|---|---|---|---|---|---|---|---|
| Toner particle No. | mother particle No. | resin content [%] | No. | Diameter [nm] | No. | Volume resistivity [Ω · cm] | Aspect ratio | Major diameter [nm] | Low-temperature fixability | Thermal storage stability | Environmental stability | Coverage stability | Remarks |
| 1 | 1 | 10 | 1 | 100 | 1 | $1.4 \times 10^{11}$ | 5.0 | 50 | A | B | A | A | Example |
| 2 | 1 | 10 | 2 | 60 | 1 | $1.4 \times 10^{11}$ | 5.0 | 50 | B | B | A | A | Example |
| 3 | 1 | 10 | 3 | 140 | 1 | $1.4 \times 10^{11}$ | 5.0 | 50 | A | A | A | A | Example |
| 4 | 1 | 10 | 1 | 100 | 2 | $3.0 \times 10^{10}$ | 5.0 | 50 | B | B | B | B | Example |
| 5 | 1 | 10 | 1 | 100 | 3 | $9.0 \times 10^{11}$ | 5.0 | 50 | B | B | B | B | Example |
| 6 | 1 | 10 | 1 | 100 | 4 | $1.2 \times 10^{10}$ | 3.5 | 60 | B | B | A | B | Example |
| 7 | 1 | 10 | 1 | 100 | 5 | $2.0 \times 10^{11}$ | 9.3 | 100 | A | B | A | B | Example |
| 8 | 1 | 10 | 4 | 40 | 1 | $1.4 \times 10^{11}$ | 5.0 | 50 | A | B | B | B | Example |

TABLE 5-continued

| Toner particle No. | Toner mother particle No. | Crystalline resin content [%] | Spherical silica No. | Spherical silica Diameter [nm] | Inorganic fine particle No. | Inorganic fine particle Volume resistivity [Ω · cm] | Inorganic fine particle Aspect ratio | Inorganic fine particle Major diameter [nm] | Evaluation Item Low-temperature fixability | Evaluation Item Thermal storage stability | Evaluation Item Environmental stability | Evaluation Item Coverage stability | Remarks |
|---|---|---|---|---|---|---|---|---|---|---|---|---|---|
| 9 | 1 | 10 | 1 | 100 | 6 | $2.5 \times 10^{8}$ | 5.0 | 50 | A | B | C | C | Comparative Example |
| 10 | 1 | 10 | 5 | 200 | 1 | $1.4 \times 10^{11}$ | 5.0 | 50 | A | A | B | B | Example |
| 11 | 1 | 10 | 1 | 100 | 7 | $8.5 \times 10^{10}$ | 1.2 | 30 | A | B | B | C | Comparative Example |
| 12 | 1 | 10 | 1 | 100 | 8 | $6.8 \times 10^{10}$ | 5.0 | 120 | A | B | C | C | Comparative Example |
| 13 | 2 | 0 | 1 | 100 | 1 | $1.4 \times 10^{11}$ | 5.0 | 50 | C | A | C | B | Comparative Example |

The results shown in TABLE 5 demonstrate that toners 1 to 8 and 10 of Examples exhibit small decreases in charge level under the high-temperature, high-humidity environment, small decreases in charge level after printing under a high coverage rate and a low coverage rate, and superior low-temperature fixability and thermal storage stability, and thus have high compatibility between these properties. The improved stability of the charge level is probably caused by a number average major axis in primary particles in the range of 50 to 100 nm, an average aspect ratio in the range of 3 to 10, and a volume resistivity in the range of $1\times10^{10}$ to $1\times10^{12}$ Ω·cm. In contrast, toners 9 and 11 to 13 of Comparative Examples, compatibility between them cannot be achieved.

As described above, the present invention provides a toner that has both low-temperature fixability and thermal storage stability, and excellent stability of the charge level under different print environments and coverage rates, and thus can output stable images under high-temperature, high-humid environments and conditions of high coverage rate.

What is claimed is:

1. An electrostatic image developing toner comprising:

a toner mother particle containing a colorant and a binder resin comprising a crystalline resin and an amorphous resin; and an external additive, wherein the external additive comprises an inorganic fine particle having a number average major axis in a range of 50 to 100 nm, an average aspect ratio in a range of 3 to 10, and a volume resistivity in a range of $1\times10^{10}$ to $1\times10^{12}$ Ω·cm in primary particles.

2. The electrostatic image developing toner of claim 1, wherein the inorganic fine particle comprises rutile titanium dioxide surface-modified with an alkoxy silane coupling agent having an alkyl group.

3. The electrostatic image developing toner of claim 1, wherein the external additive comprises the inorganic fine particle and a silica particle having a number average primary particle size in a range of 60 to 150 nm.

4. The electrostatic image developing toner of claim 1, wherein the crystalline resin comprises a crystalline polyester.

5. The electrostatic image developing toner of claim 2, wherein the alkoxy silane coupling agent comprises an alkoxy silane coupling agent having an alkyl group represented by Formula (1):

$$R_1\text{—}Si(OR_2)_3 \qquad \text{Formula (1)}$$

wherein $R_1$ represents a linear alkyl group having a carbon number of 4 to 16 and optionally having a substituent; and $R_2$ represents a methyl or ethyl group.

6. The electrostatic image developing toner of claim 1, wherein the inorganic fine particle is added in an amount in a range of 0.1 to 1.0 part by mass relative to 100 parts by mass of the toner mother particle.

7. The electrostatic image developing toner of claim 1, wherein the amorphous resin content in the toner mother particle is in a range of 70 to 99 mass % to the total mass of the binder resin.

8. A two-component electrostatic image developer comprising the electrostatic image developing toner of claim 1 and a carrier particle.

9. The two-component developer of claim 8, wherein the carrier particle is a coated type carrier particle comprising a core and a shell covering the surface of the core, and the shell comprises a resin having a cycloalkyl group.

* * * * *